US007322324B2

(12) United States Patent
Hara et al.

(10) Patent No.: US 7,322,324 B2
(45) Date of Patent: Jan. 29, 2008

(54) VALVE OPERATING APPARATUS OF INTERNAL COMBUSTION ENGINE

(75) Inventors: Seinosuke Hara, Kanagawa (JP); Makoto Nakamura, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/472,254

(22) Filed: Jun. 22, 2006

(65) Prior Publication Data

US 2006/0288972 A1 Dec. 28, 2006

(30) Foreign Application Priority Data

Jun. 28, 2005 (JP) ..... 2005-187511
Feb. 24, 2006 (JP) ..... 2006-047658

(51) Int. Cl.
*F01L 1/34* (2006.01)

(52) U.S. Cl. ..... 123/90.16; 123/90.15; 123/90.31

(58) Field of Classification Search ..... 123/90.16, 123/90.15, 90.31, 90.39
See application file for complete search history.

(56) References Cited

U.S. PATENT DOCUMENTS 6,691,654 B2 * 2/2004 Uehara et al. ..... 123/90.16
6,907,852 B2 6/2005 Schleusener et al.

FOREIGN PATENT DOCUMENTS

| | | |
|---|---|---|
| JP | 2004-521234 A | 7/2004 |
| JP | 2005-9330 A | 1/2005 |
| WO | WO 02/092972 A1 | 11/2002 |

* cited by examiner

*Primary Examiner*—Zelalem Eshete
(74) *Attorney, Agent, or Firm*—Foley & Lardner LLP

(57) ABSTRACT

In a valve operating apparatus of an engine capable of varying a valve lift characteristic, rotary motion of a drive cam is converted through a motion-conversion linkage including a rocker arm into oscillating motion of a valve actuation member for operating an engine valve. Also provided is a control shaft whose angular position is adjusted depending on an engine operating condition for changing a linkage attitude. The valve actuation member has an arcuate portion curved to bypass the drive shaft. The control shaft has a coaxial shaft portion and an eccentric control cam. The control cam is a fulcrum of oscillating motion of the rocker arm and the coaxial shaft portion of the control shaft is a fulcrum of oscillating motion of the valve actuation member. The fulcrums are laid out in close proximity to each other.

20 Claims, 15 Drawing Sheets

VALVE OPERATING APPARATUS OF INTERNAL COMBUSTION ENGINE

TECHNICAL FIELD

The present invention relates to a valve operating apparatus of an internal combustion engine, capable of variably controlling a valve lift characteristic (a valve lift amount and a valve timing) of an engine valve, for example, an intake valve or an exhaust valve.

BACKGROUND ART

In recent years, there have been proposed and developed various variable valve operating devices capable of variably controlling an engine valve lift characteristic. Such variable valve operating devices have been disclosed in (i) International Publication No. WO 02/092972 corresponding to U.S. Pat. No. 6,907,852, and also corresponding to Japanese Patent Provisional Publication No. 2004-521234 (hereinafter is referred to as "JP2004-521234"), and (ii) Japanese Patent Provisional Publication No. 2005-009330 (hereinafter is referred to as "JP2005-009330").

In the variable valve operating device disclosed in JP2004-521234 (WO 02/092972), a drive cam fixed to a camshaft creates oscillating motion of a spring-loaded pivoting lever (a valve actuation member). The oscillating motion of the pivoting lever is transmitted via a swing arm (a motion-transmission element or a motion-transfer element) to the valve stem end of an intake valve, so as to open and close the intake valve. Also provided is a curved disc-shaped member, serving as an eccentric cam and constructing part of a variable valve-lift adjustment mechanism (simply, a variable valve lift mechanism). The curved disc-shaped member (eccentric cam) is rotatable about its rotation center, while being kept in abutted-engagement with the pivoting lever. Rotary motion of the eccentric cam changes the fulcrum of oscillating motion of the pivoting lever, thereby enabling variable control of the valve lift characteristic of the intake valve.

On the other hand, the variable valve operating device disclosed in JP2005-009330 assigned to the assignee of the present invention, is comprised of a drive shaft formed on its outer periphery with a drive eccentric-cam, a rockable cam fixed to a cylindrical camshaft, which camshaft is rotatably supported on the outer periphery of the drive shaft so as to open and close an intake valve by way of rockable motion of the rockable cam, a rocker arm rotatably linked at one end to the drive eccentric-cam via a link arm and rotatably linked at the other end to the rockable cam via a link rod, and a control cam fixed to a control shaft extending in the longitudinal direction of the engine, for changing the fulcrum of oscillating motion of the rocker arm. Concretely, the fulcrum of oscillating motion of the rocker arm is changed by rotating the control cam to a desired angular position via the control shaft by means of an actuator, depending on an engine operating condition. Changing the fulcrum of oscillating motion of the rocker arm results in a change in an engine valve lift characteristic.

SUMMARY OF THE INVENTION

However, in the variable valve operating device disclosed in JP2004-521234 (WO 02/092972), a variable valve lift mechanism, constructed by at least the pivoting lever (valve actuation member) and the curved disc-shaped member (eccentric cam), is interleaved in a space defined between the drive cam of the camshaft and the intake valve. Owing to such a layout of the variable valve lift mechanism between the drive cam and the intake valve, the axis of the valve stem of the intake valve must be adequately spaced apart from the shaft axis of the camshaft, so that a distance between the axis of the valve stem of the intake valve and the shaft axis of the camshaft is adequately long enough to lay out the variable valve lift mechanism between the drive cam and the intake valve. For the reasons discussed above, the camshaft must be arranged on the cylinder head within a particular space except the variable valve lift mechanism installation space. That is, the existing cylinder-head layout cannot be applied to such a valve operating device disclosed in JP2004-521234 (WO 02/092972). In other words, the valve operating device disclosed in JP2004-521234 (WO 02/092972) requires a large design change of the existing cylinder-head layout in construction. This leads to some problems, such as higher valve operating system installation time and manufacturing costs, and larger space requirements of overall system.

On the other hand, in the variable valve operating device disclosed in JP2005-009330, the multi-link mechanism is configured to transmit motion from the drive cam via the link arm to the rockable cam. Thus, the degree of freedom in layout of the camshaft is high. However, the fulcrum of oscillating motion of the rocker arm and the fulcrum of the rockable cam differ from each other perfectly. Due to each individual multi-link component-part's machining accuracies and/or installation error, there is a possibility that the two different fulcrums of oscillating motions are deviated or offset from their normal positions. In the presence of the undesirable deviation of the fulcrum of oscillating motion of the rocker arm from its normal position and the undesirable deviation of the fulcrum of oscillating motion of the rockable cam from its normal position, it is difficult to ensure a desired valve lift characteristic.

It is, therefore, in view of the previously-described disadvantages of the prior art, an object of the invention to provide a variable valve operating apparatus of an internal combustion engine, capable of preventing a design valve-lift characteristic from being undesirably changed and affected by each individual component-part's machining accuracies and/or installation error of a multi-link mechanism, in spite of the utilization of an existing cylinder-head layout.

In order to accomplish the aforementioned and other objects of the present invention, a valve operating apparatus of an internal combustion engine comprises a drive shaft adapted to be linked to an engine crankshaft from which a driving force is transmitted to the drive shaft, the drive shaft having a drive cam, a control shaft whose angular position is adjusted depending on an engine operating condition, the control shaft having a coaxial shaft portion laid out coaxially with a rotation axis of the control shaft and a control cam whose axis is deviated from the control-shaft rotation axis, a rocking member that oscillates on the control cam, which is a fulcrum of oscillating motion of the rocking member, by an oscillating force converted from rotary motion of the drive cam, and a valve actuation member that oscillates on the coaxial shaft portion, which is a fulcrum of oscillating motion of the valve actuation member, by the oscillating force transmitted from the rocking member, for opening and closing an engine valve.

According to another aspect of the invention, a valve operating apparatus of an internal combustion engine comprises a drive cam formed integral with a drive shaft adapted to be linked to an engine crankshaft from which a driving force is transmitted to the drive shaft, a control cam formed integral with a control shaft whose angular position is adjusted depending on an engine operating condition, the control cam having an axis deviated from a rotation axis of the control shaft, a rocking member that oscillates by an oscillating force converted from rotary motion of the drive cam, a valve actuation member that opens and closes an engine valve by the oscillating force transmitted from the rocking member, the rocking member rockably supported on the control cam, which is a fulcrum of oscillating motion of the rocking member, the valve actuation member rockably supported on the control shaft, which is a fulcrum of oscillating motion of the valve actuation member, and the fulcrums being laid out in close proximity to each other.

According to a further aspect of the invention, a valve operating apparatus of an internal combustion engine, capable of variably controlling a valve lift and a valve timing of an engine valve (3) depending on an engine operating condition, comprises a drive shaft adapted to be linked to an engine crankshaft from which a driving force is transmitted to the drive shaft, the drive shaft having a drive cam, a control shaft whose angular position is adjusted depending on the engine operating condition, the control shaft having a coaxial shaft portion laid out coaxially with a rotation axis of the control shaft and a control cam whose axis is deviated from the control-shaft rotation axis, a rocking member that oscillates on the control cam, which is a fulcrum of oscillating motion of the rocking member, by an oscillating force converted from rotary motion of the drive cam, a valve actuation member that oscillates on the coaxial shaft portion, which is a fulcrum of oscillating motion of the valve actuation member, by the oscillating force transmitted from the rocking member, a cam follower being in abutted-engagement with the valve actuation member for opening and closing the engine valve, and a mutual position relationship of the drive shaft, the control shaft, and the cam follower being defined by a layout that a distance between the drive shaft and the cam follower is dimensioned to be shorter than a distance between the control shaft and the cam follower.

According to a still further aspect of the invention, a valve operating apparatus of an internal combustion engine comprises a drive shaft adapted to be linked to an engine crankshaft from which a driving force is transmitted to the drive shaft, the drive shaft having a drive cam, a control shaft whose angular position is adjusted depending on an engine operating condition, the control shaft having a coaxial shaft portion laid out coaxially with a rotation axis of the control shaft and a control cam whose axis is deviated from the control-shaft rotation axis, a rocking member abutting at a first end of both ends with an outer peripheral surface of the drive cam from which rotary motion is transmitted to the first end, the rocking member rockably mounted at the second end on the control cam, which is a fulcrum of oscillating motion of the rocking member, a valve actuation member that oscillates on the coaxial shaft portion, which is a fulcrum of oscillating motion of the valve actuation member, by the oscillating force transmitted from the rocking member through a link member laid out inside of both of the rocking member and the valve actuation member, for opening and closing an engine valve, and a preloading means that forces the first end of the rocking member into abutted-engagement with the outer peripheral surface of the drive cam.

According to another aspect of the invention, a valve operating apparatus of an internal combustion engine, capable of variably controlling a valve lift and a valve timing of an engine valve depending on an engine operating condition, comprises a drive shaft adapted to be linked to an engine crankshaft from which a driving force is transmitted to the drive shaft, the drive shaft having a drive cam, a control shaft whose angular position is adjusted depending on the engine operating condition, the control shaft having a coaxial shaft portion laid out coaxially with a rotation axis of the control shaft and a control cam having an axis deviated from the control-shaft rotation axis, a rocking member that oscillates on the control cam, which is a fulcrum of oscillating motion of the rocking member, by an oscillating force converted from rotary motion of the drive cam, a valve actuation member that oscillates on the coaxial shaft portion, which is a fulcrum of oscillating motion of the valve actuation member, by the oscillating force transmitted from the rocking member, for opening and closing the engine valve, the rocking member and the valve actuation member being pivotably supported on the control shaft, and the drive shaft being laid out below the control shaft, the drive shaft being offset from the control shaft toward a valve stem end of the engine valve.

The other objects and features of this invention will become understood from the following description with reference to the accompanying drawings.

DESCRIPTION OF THE PREFERRED EMBODIMENTS

Figure 1:
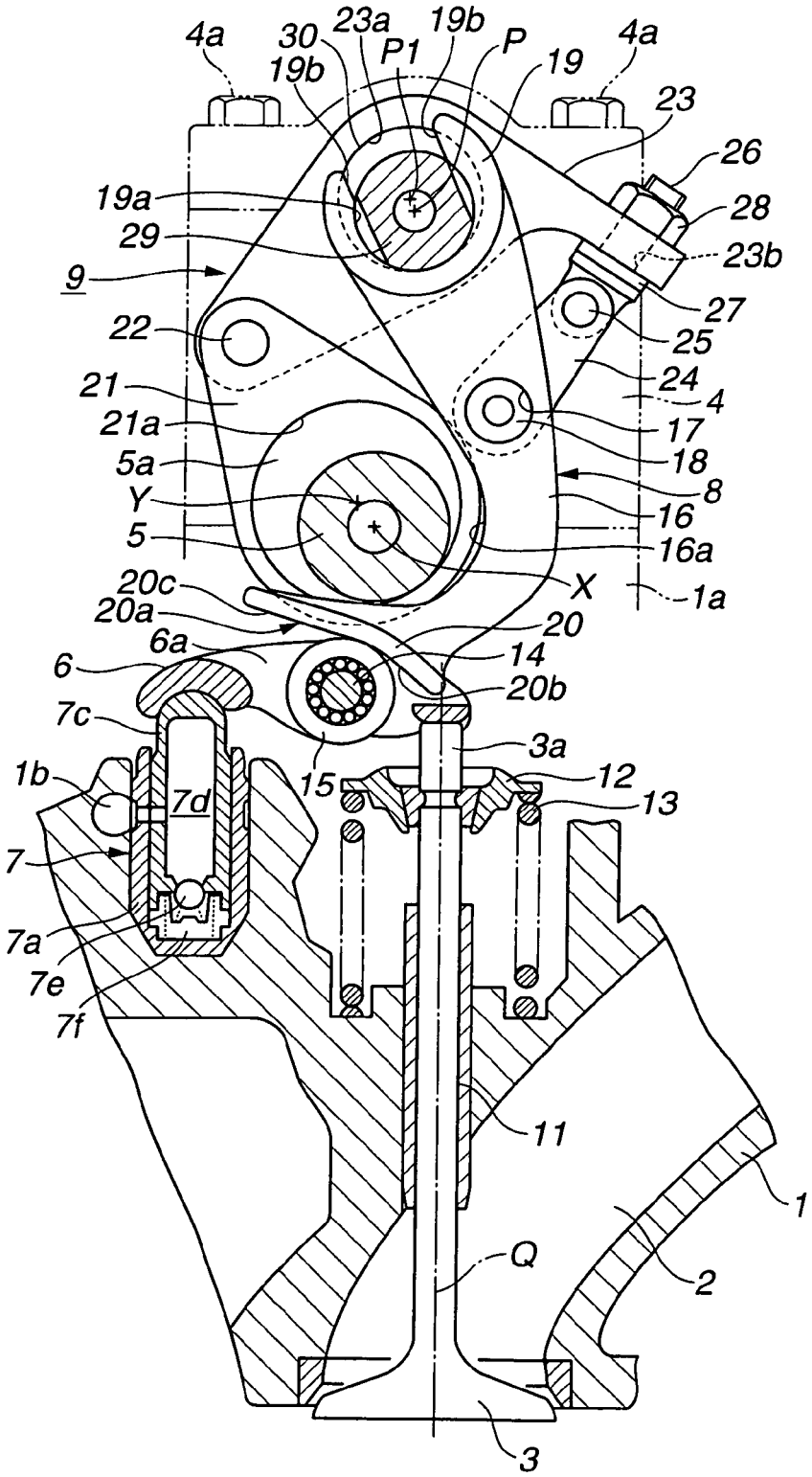
FIG. 1 is a side view showing a first embodiment of a variable valve operating apparatus, partly cross-sectioned.
Figure 2:
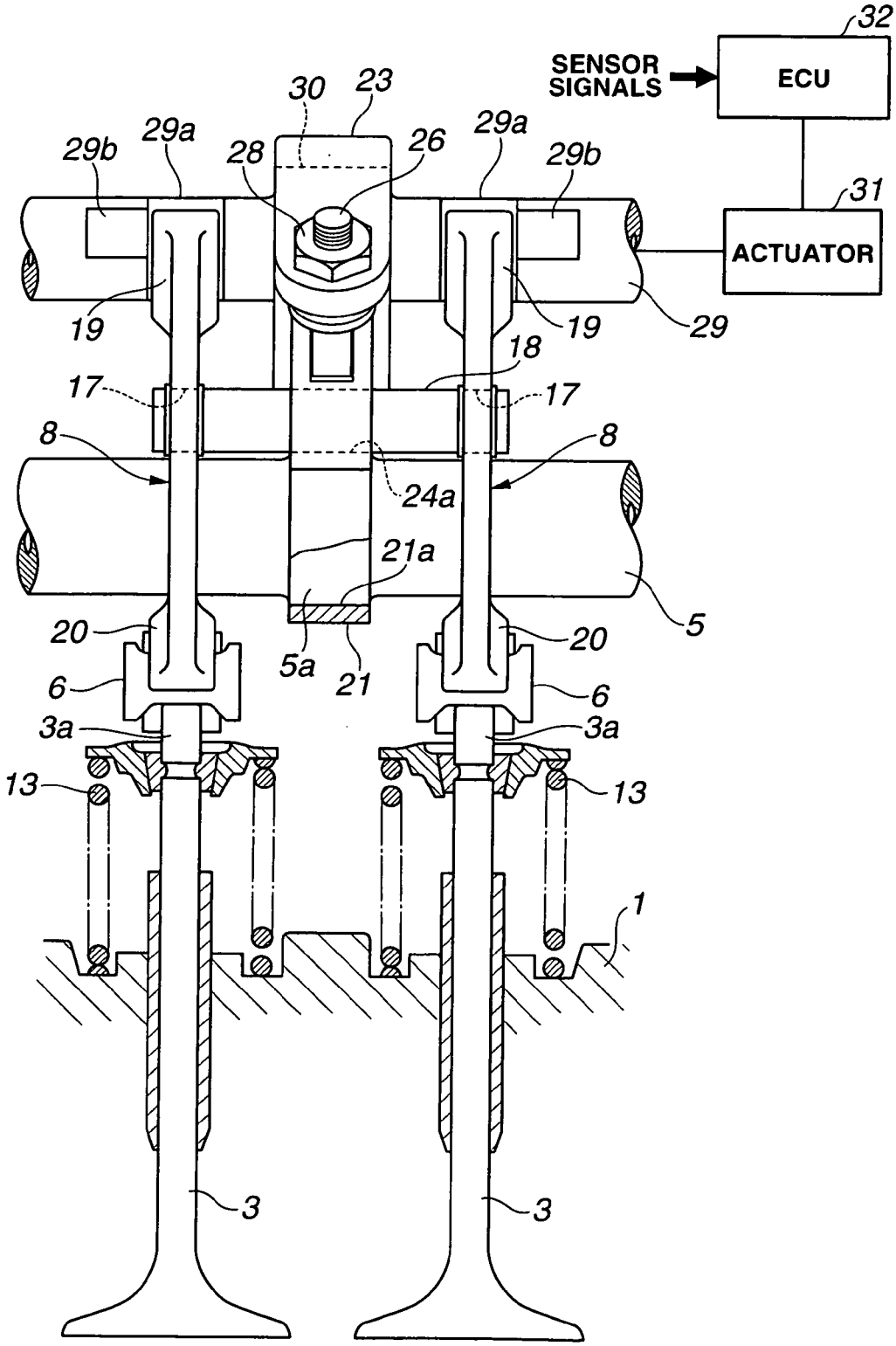
FIG. 2 is an elevation view showing the valve operating apparatus of the first embodiment shown in FIG. 1.
Figure 3:
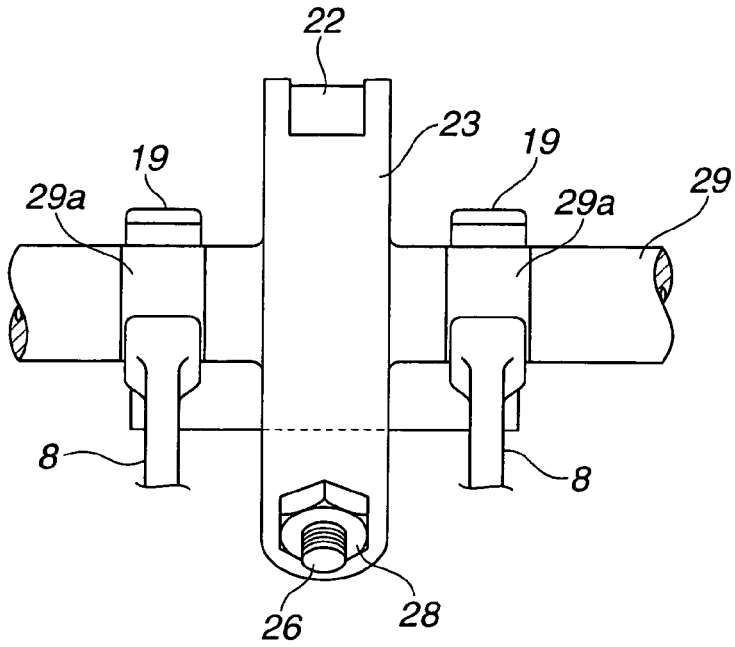
FIG. 3 is a plan view showing the essential part of the valve operating apparatus of the first embodiment.

Referring now to the drawings, particularly to FIGS. 1-3, the variable valve operating apparatus of the first embodiment is exemplified in a multiple cylinder internal combustion engine employing two intake-port valves per cylinder. As best seen from FIG. 2, two intake valves 3, 3 per cylinder are provided in a cylinder head 1 for opening and closing respective intake ports 2, 2. Each of intake valves 3, 3 is slidably supported by respective cylindrical valve guides 11, 11 installed in cylinder head 1. Each of intake valves 3, 3 is permanently forced in a valve-closing direction by a valve spring 13. Valve spring 13 is operably disposed between a valve-spring seat formed in cylinder head 1 and a valve-spring retainer installed on the valve stem of intake valve 3 near the valve stem end 3*a*.

As shown in FIGS. 1-3, the valve operating apparatus of the first embodiment is comprised of a camshaft 5, a pair of swing arms 6, 6, a pair of automatic valve-lash adjusters (hydraulic lash adjusters) 7, 7, a pair of valve actuation members 8, 8, and a variable valve lift mechanism 9.

Camshaft 5 is installed on the upper end of cylinder head 1 in such a manner as to extend in the longitudinal direction of the engine. Camshaft 5 is rotatably supported by means of a camshaft bearing device containing two bearing blocks 4 and 1*a*. More concretely, the lower bearing block 1*a* (the first bearing block) is formed integral with cylinder head 1. Lower bearing block 1*a* includes a half-round bearing section formed in cylinder head 1. The upper flattened end face of lower bearing block 1*a* is attached to the flattened bottom face of the other bearing block (the second bearing block) 4, such that camshaft 5 is rotatably supported between the half-round bearing sections of the first and second bearing blocks 1*a* and 4. One drive cam 5*a* per cylinder is formed integral with camshaft 5 and arranged on the outer periphery of camshaft 5. That is, camshaft 5 serves as a drive shaft. The shown layout/construction of camshaft 5 is a general layout/construction having a high design flexibility. That is, camshaft 5 is arranged above the valve stem end 3*a* and located near the extended axis of the axis Q of the valve stem of intake valve 3. The axis Y of drive cam 5*a* radially deviates from the axis X of camshaft 5. The cam profile of the outer periphery of drive cam 5*a* is circular. Drive cam 5*a* is a cylindrical eccentric cam with the shaft displaced from the geometric center.

Each of swing arms 6, 6 is formed with a substantially center roller-retaining hole portion 6*a* for a roller 15. Regarding the three-dimensional shape of swing arm 6, see the solid figure of swing arm 6 in the disassembled view of FIG. 15. As can be seen from the drawings, roller shaft 14 is fixedly connected to swing arm 6 and located in roller-retaining hole portion 6*a*, such that roller 15, installed in roller-retaining hole portion 6*a*, is rotatably supported on roller shaft 14 via a ball bearing (not numbered). As described later, roller 15 is kept in abutted-engagement with (or in rolling-contact with or in cam-connection with) a cam surface 20*a* (described later) of a cam portion (20) of valve actuation member 8. That is, roller 15 serves as a cam follower for cam portion 20. As can be appreciated from the side view of FIG. 1, swing arm 6 floats. Swing arm 6 is interleaved between the cam portion 20 of valve actuation member 8 and the stem end of intake valve 3

One end (a right-hand end in FIG. 1) of swing arm 6 rests on the tip of valve stem end 3*a* of intake valve 3. The other end (a left-hand end in FIG. 1) of swing arm 6 engages with hydraulic lash adjuster 7. More concretely, the underside of the first end (the right-hand end in FIG. 1) of swing arm 6 is in abutted-engagement with the tip of valve stem end 3*a*. The underside of the second end (the left-hand end in FIG. 1) of swing arm 6 is formed as a substantially circular-arc shaped cam surface in abutted-engagement with a semi-spherical head of a plunger 7*c* of hydraulic lash adjuster 7.

Each of hydraulic lash adjusters 7, 7 included in the valve operating apparatus of the first embodiment is conventional and forms no part of the present invention. Hydraulic lash adjuster 7 is comprised of a hollow-cylinder body 7*a* having a bottom closed end and an upper opening end, and held in a cylindrical lash-adjuster retaining groove formed in cylinder head 1, a check valve 7*e*, and plunger 7*c* slidably fit in the hollow cylinder of hollow-cylinder body 7*a*. In the shown embodiment, check valve 7*e* is constructed by a ball check valve having a ball held by a spring against a seat formed with a central communication passage. A cylindrical hydraulic chamber 7*d* is defined in plunger 7*c*. Additionally, a high-pressure chamber 7*f* is defined by the bottom closed end of hollow-cylinder body 7*a*, the check valve ball of check valve 7*e*, and the bottom end of plunger 7*c*. Fluid communication between hydraulic chamber 7*d* and high-pressure chamber 7*f* is established and blocked by means of the check valve ball. In other words, the previously-noted communication passage is opened and closed by means of check valve 7*e*. As clearly shown in FIG. 1, oil (working fluid) under pressure from an engine lubricating system flows through an oil passage 1*b* formed in cylinder head 1 and small oil-holes (not numbered) formed in the sidewalls of hollow-cylinder body 7*a* and plunger 7*c* into the hydraulic chamber 7*d*. As the oil enters hydraulic chamber 7*d* of plunger 7*c*, the oil pressure acts on the ball of check valve 7*e* in the bottom of the plunger, forcing it open. Oil further passes the check valve ball and enters the high-pressure chamber 7*f*. Therefore, plunger 7*c* is forced upward. The upward movement of plunger 7*c* raises the second end (the left-hand end in FIG. 1) of swing arm 6 such that roller 15 of swing arm 6 moves up into contact with cam portion 20 of valve actuation member 8. Owing to a reaction force from cam portion 20 to roller 15, the first end (the right-hand end in FIG. 1) of swing arm 6 is forced into contact with the tip of valve stem end 3*a*. This action adjusts or reduces the lash defined between the first end (the right-hand end in FIG. 1) of swing arm 6 and the tip of valve stem end 3*a* to zero.

Each of valve actuation members 8, 8 is laid out in such a manner as to bypass camshaft 5. The lower cam portions 20, 20 of valve actuation members 8, 8 are in contact with respective rollers 15, 15 of swing arms 6, 6, so that valve actuation members 8, 8 operate respective intake valves 3, 3 via swing arms 6, 6. As seen from the side view of shown in FIG. 1, each of valve actuation members 8, 8 is formed of metal material by way of press molding and curved into a substantially L shape. As appreciated from the elevation view of FIG. 2, valve actuation members 8, 8, associated with respective intake valves 3, 3, are arranged symmetrically with respect to the common drive cam 5*a*. An installation position of valve actuation member 8 is offset from an installation position of drive cam 5*a* in a direction of the axis X of the drive shaft (camshaft 5). The substantially lower half of valve actuation member 8 is formed as an arcuate portion 16, which is curved in a manner so as to bypass the outer periphery of camshaft 5. The upper part of arcuate portion 16 is formed with a through hole (a connecting-shaft insertion hole) 17. As can be seen from FIGS. 1-2, both ends of a common connecting shaft 18 are fitted to respective through holes 17, 17 of the valve actuation member pair 8, 8, so that the two valve actuation members are mechanically linked to each other via the common connecting shaft 18. C-shaped retaining rings or snap rings are fitted to respective annular grooves formed in the connecting-shaft ends so that the common connecting shaft 18 is itself locked in place. The upper end of valve actuation member 8 is formed as a substantially C-shaped pivotal-fitting portion, simply, a pivoting portion 19, opening upwards.

Figure 4:
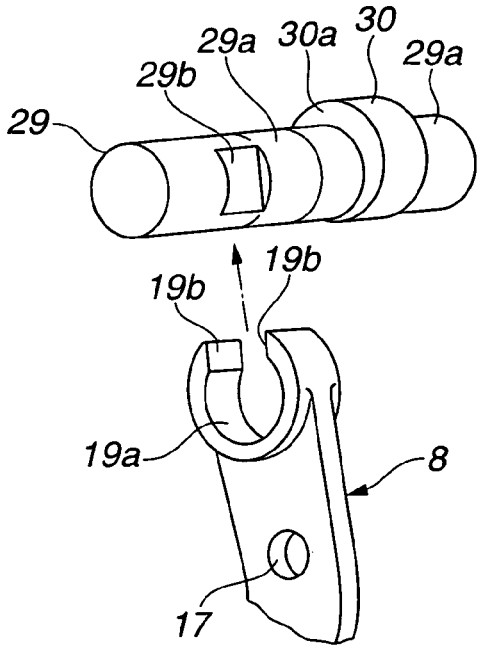
FIG. 4 is a disassembled view showing the essential part corresponding to a control shaft and a valve actuation member, constructing part of the valve operating apparatus of the first embodiment.

As clearly shown in FIG. 4, the previously-noted pivoting portion 19 is pivotably fitted onto the outer periphery of a control shaft 29 (described later). Pivoting portion (or pivotal-fitting portion) 19 has a circular fitting hole 19*a* bored in the center of pivoting portion 19. The central fitting hole 19*a* is fitted onto the outer peripheral surface of control shaft 29. Pivoting portion 19 is also formed with two opposing parallel cut-out portions 19*b*, 19*b* extending substantially radially outwards from the center of central fitting hole 19*a* and defining the opening end of pivoting portion 19. Two opposing cut-out portions 19*b*, 19*b*, extending substantially radially outwards from the center of fitting hole 19*a*, are formed in the outer peripheral wall of pivoting portion 19 defining the fitting hole 19*a*. The inside dimension of the opening end defined by the two opposing cut-out portions 19*b*, 19*b* is dimensioned to be slightly greater than a width of width across flats 29*b* (described later) formed on control shaft 29 and smaller than the outside diameter of control shaft 29. Described later, the cut-out portions 19*b*, 19*b* of pivoting portion 19 are needed for the ease of installation of valve actuation member 8 on control shaft 29 and high reliability of pivotal fitting of valve actuation member 8 onto control shaft 29.

The internal surface 16*a* of arcuate portion 16, facing the outer periphery of camshaft 5, is curved in a manner so as to bypass the cylindrical-hollow camshaft 5. Arcuate portion 16 of valve actuation member 8 is integrally formed at the lower end with cam portion 20 in rolling-contact with roller 15 (cam follower) of swing arm 6. Cam portion 20 is formed as a substantially boomerang-shaped elongated cam plate. The underside of cam portion 20 is formed as a moderately-curved cam surface 20*a*. Cam surface 20*a* is configured so that the right-hand cam-surface section (in the side view of FIG. 1) corresponding to the base of cam portion 20 formed integral with the lower end of arcuate portion 16 is formed as a curved surface having a relatively small radius of curvature, and the left-hand cam-surface section (in the side view of FIG. 1) corresponding to the extension of cam portion 20 ranging from the substantially central concave portion of cam surface 20*a* to the thin-walled tip (the leftmost end in FIG. 1) is formed as a moderately curved surface having a relatively large radius of curvature. That is, the right-hand cam-surface section corresponding to the base of a relatively small radius of curvature is formed as a lift surface 20*b*, whereas the left-hand cam-surface section corresponding to the extended cam portion of a relatively large radius of curvature is formed as a base-circle surface 20*c*.

As shown in FIG. 1, variable valve lift mechanism 9 is arranged between drive cam 5*a* and each of valve actuation members 8, 8. Variable valve lift mechanism 9 is comprised of a motion-transmission mechanism and a control mechanism. The motion-transmission mechanism is provided to transmit rotary motion (or torque) of camshaft 5 into each of valve actuation members 8, 8. The control mechanism is provided to change the attitude/position of the motion-transmission mechanism depending on an engine operating condition.

The motion-transmission mechanism is comprised of a link arm 21, a rocker arm (a rocking member) 23, and a link member 24. Link arm 21 is rotatably (or pivotably) linked at one end (a first end) to drive cam 5*a*. Rocker arm 23 is rotatably (or pivotably) linked at one end (a first end) to the other end (the second end) of link arm 21 via a connecting pin 22. Link member 24 serves to mechanically link the other end (the second end) of rocker arm 23 and each valve actuation member 8 via connecting shaft 18. Link arm 21 is formed into a raindrop shape. Link arm 21 is formed with a large-diameter fitting hole 21*a* bored in the first end of link arm 21. Drive cam 5*a* is fitted into the fitting hole 21*a* of link arm 21, so that drive cam 5*a* is rotatable in the fitting hole 21*a*. Link arm 21 is formed with a small-diameter connecting-pin insertion hole (not numbered) bored in the second end of link arm 21, such that connecting pin 22 is fitted into the connecting-pin insertion hole for pin-connection between link arm 21 and rocker arm 23.

As seen from the side view of FIG. 1, rocker arm 23 is formed as a substantially boomerang-shaped arm. Rocker arm 23 is formed with a circular large-diameter cam hole 23*a* bored in the substantially center portion of rocker arm 23. A control cam 30 (described later) of the control mechanism is rotatably fitted into cam hole 23*a*. In a similar manner to link arm 21, rocker arm 23 is also formed with a small-diameter connecting-pin insertion hole (not numbered) bored in the first end of rocker arm 23, such that connecting pin 22 is fitted into the connecting-pin insertion hole for pin-connection between link arm 21 and rocker arm 23. The second end of rocker arm 23 is formed as a flat plate-shaped portion. The flat plate-shaped portion (the second end) of rocker arm 23 has a bolt insertion hole 23*b* into which an adjusting bolt 26 of the adjusting mechanism (described later) is inserted. Rocker arm 23 serves as a rocking member or an oscillating member.

Figure 5:
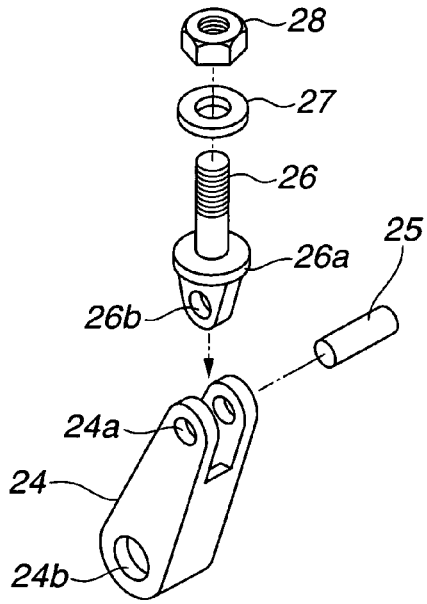
FIG. 5 is a disassembled view showing an adjusting mechanism included in the valve operating apparatus of the first embodiment.

As shown in FIGS. 1 and 5, link member 24 is formed of metal material by way of press molding and curved into a substantially U shape or a forked shape in cross section. Each of the two parallel plate-shaped portions of the forked end of link member 24 has a connecting-pin insertion hole 24*a* for pin-connection between link member 24 and the adjusting mechanism (hereunder described in detail) via a connecting pin 25. On the other hand, the other end of link member 24, opposing to the forked end, has through holes (connecting-shaft insertion holes) 24*b*. The forked end of link member 24 is linked through the adjusting mechanism to the second end of rocker arm 23. The other end of link member 24 is rotatably linked through the common connecting shaft 18 fitted into the through holes 24*b* to the valve actuation member pair 8, 8.

As can be seen from FIGS. 1 and 5, the adjusting mechanism is comprised of adjusting bolt 26, a shim 27, and a nut 28. One end of adjusting bolt 26 is connected to the forked end of link member 24 via connecting pin 25 whose both ends are fitted to the respective insertion holes 24*a*, 24*a* of the link-member forked end. Shim 27 is interleaved between the annular bearing surface of head 26*a* of adjusting bolt 26 and the flat-faced portion of the second end of rocker arm 23. Nut 28 is screwed onto the male screw-threaded portion of adjusting bolt 26. The head portion of adjusting bolt 26 has a substantially D-shaped tab-like portion formed integral with the annular bearing-surface head portion. The D-shaped tab-like portion of adjusting-bolt head 26*a* has a pin-insertion hole 26*b* bored therein. The D-shaped tab-like portion of head 26*a* is rotatably linked to link member 24 by fitting the connecting pin 25 into three through holes 24*a*, 26*b*, and 24*a*, under a condition where the three holes are axially aligned to each other. Shim 27 is formed just like a plane washer. Properly selecting one of some kinds of shims differing from each other in thickness allows extremely small adjustments for the entire length of a linkage, containing link member 24 and rockably interconnecting the second end of rocker arm 23 and the substantially center portion of each valve actuation member 8, to be made. The extremely small adjustments for the entire linkage length enable extremely small adjustments for the valve lift characteristic of intake valve 3.

The control mechanism is comprised of control shaft 29 arranged parallel to the axis X of camshaft 5 in such a manner as to extend in the longitudinal direction of the engine, control cam 30 fixedly connected to or integrally formed with control shaft 29 and laid out between the valve actuation member pair 8, 8, and an electric actuator 31. Actuator 31 is provided to adjust the angular position of control shaft 29 responsively to a control command signal generated from an electric control unit 32 and determined based on an engine operating condition.

Control shaft 29 is a cylindrical-hollow shaft. Several control-shaft sections are formed as axially-spaced journal portions. As best seen from the side view of FIG. 1, the previously-discussed second bearing block 4 is comprised of a bearing cap portion (not numbered) having a half-round bearing section used to rotatably support control shaft 29 and the intermediate bearing block portion 4*b* (see FIG. 13) formed with the upper half of the half-round bearing sections used to rotatably support camshaft 5 (the drive shaft). The intermediate bearing block portion 4*b* of second bearing block 4 is also formed at its upper end with a half-round bearing section used to rotatably support control shaft 29. Actually, each of the journal portions of control shaft 29 are rotatably supported between the upper and lower half-round bearing sections of the bearing cap portion and the intermediate bearing block portion of second bearing block 4. Control shaft 29 is formed integral with a pair of coaxial shaft portions 29*a*, 29*a* laid out on both sides of control cam 30. Coaxial shaft portions 29*a*, 29*a* are arranged coaxially with (or concentrically with) the rotation axis P of control shaft 29. Two coaxial shaft portions 29*a*, 29*a* pivotably support the respective upper ends of valve actuation members 8, 8 through the fitting holes 19*a*, 19*a* of pivoting portions 19, 19. A first group of width across flats (or left-hand surfaced two sides in FIG. 2) 29*b* is formed on the outer periphery of control shaft 29 and located axially outside of and adjacent to the left-hand coaxial shaft portion 29*a*. In a similar manner, a second group of width across flats (or right-hand surfaced two sides in FIG. 2) 29*b* is formed on the outer periphery of control shaft 29 and located axially outside of and adjacent to the right-hand coaxial shaft portion 29*a*. When assembling, two pairs of cut-out portions (19*b*, 19*b*; 19*b*, 19*b*) of pivoting portions 19, 19 of valve actuation members 8, 8 are inserted or fitted onto control shaft 29 through the respective groups of width across flats 29*b*, 29*b* formed axially outside of and adjacent to two coaxial shaft portions 29*a*, 29*a*. Thereafter, valve actuation members 8, 8 are axially displaced toward the respective coaxial shaft portions 29*a*, 29*a* through the fitting holes 19*a*, 19*a* of pivoting portions 19, 19. In this manner, the upper ends (pivoting portions 19, 19) of valve actuation members 8, 8 can be pivotably mounted on the respective coaxial shaft portions 29*a*, 29*a* of control shaft 29. That is, the coaxial shaft portions 29*a*, 29*a* serve as the pivots of valve actuation members 8, 8. As discussed above, even when control cam 30 has been formed integral with control shaft 29 in advance, pivotal-fitting portion 19 having the opening end allows easy installation of valve actuation member 8 on the coaxial shaft portion 29*a* of control shaft 29 from the substantially radial direction of control shaft 29. Suppose that the upper pivotal-fitting portion of the valve actuation member must be inserted from a shaft end of the control shaft. If the control cam has been formed integral with the control shaft in advance, the control cam functions as an obstructive load against axial sliding motion of the upper pivotal-fitting portion of the valve actuation member. In contrast, in the first embodiment, by virtue of pivotal-fitting portion 19 having the opening end, in other words, by the installing method of valve actuation member 8 on the coaxial shaft portion 29*a* from the substantially radial direction of control shaft 29, there is no possibility that control cam 30 functions as an obstructive load when assembling.

Actually, in the shown embodiment, control cam 30 is integrally formed with control shaft 29. One control cam 30 per engine cylinder is provided. The cam profile of the outer periphery of control cam 30 is circular. The axis P1 of control cam 30 slightly radially deviates from the axis (the rotation axis P) of control shaft 29 by a predetermined eccentricity (i.e., a distance between the axes P and P1). That is, control cam 29 is a cylindrical eccentric cam with the shaft displaced from the geometric center. The outside diameter of control cam 30 is dimensioned to be slightly less than the inside diameter of cam hole 23*a* of rocker arm 23 to allow oscillating motion of rocker arm 23 relative to control cam 30. That is, control cam 30 serves as the fulcrum (the pivot) of oscillating motion of rocker arm 23.

The distance between the axis X of camshaft 5 and the axis of roller shaft 14 of roller 15 of each of swing arms 6, 6 spaced apart from camshaft 5, is dimensioned to be adequately shorter than the distance between the axis (rotation center P) of control shaft 29 and the axis of roller shaft 14.

The bearing cap portion and the intermediate bearing block portion, both constructing the second bearing block 4, and the first bearing block 1*a* of cylinder head 1 are integrally connected to each other by screwing mounting bolts 4*a*, 4*a* through mounting-bolt holes formed in the second bearing block 4 into female-screw threaded portions formed in the first bearing block 1*a*.

Electric actuator 31 is comprised of an electric motor and a reduction gear. Actuator 31 is configured to adjust and hold control shaft 29 to a desired angular position by rotating control shaft 29 in a normal-rotational direction or in a reverse-rotational direction depending on an engine operating condition. The operation (the driving state) of the electric motor of actuator 31 is controlled in response to a control command signal (a control current or a driving current) from control unit 32.

As shown in FIG. 2, control unit (ECU) 32 generally comprises a microcomputer. Control unit 32 includes an input/output interface (I/O), memories (RAM, ROM), and a microprocessor or a central processing unit (CPU). The input/output interface (I/O) of control unit 32 receives input information from various engine/vehicle switches and sensors, namely a crank angle sensor, a throttle opening sensor, an engine temperature sensor (e.g., an engine coolant temperature sensor), an airflow meter, and the like. Within control unit 32, the central processing unit (CPU) allows the access by the I/O interface of input informational data signals from the previously-discussed engine/vehicle switches and sensors. The CPU of control unit 32 is responsible for carrying the electric-motor control program stored in memories and is capable of performing necessary arithmetic and logic operations containing a variable valve lift characteristic control management processing. Computational results (arithmetic calculation results), that is, a calculated output signal is relayed through the output interface circuitry of the control unit to an output stage, namely electric actuator 31 included in the control mechanism.

The operation of the valve operating apparatus of the first embodiment is hereunder described in detail.

First, opening and closing actions of each of intake valves 3, 3 are explained. Torque, transmitted from an engine crankshaft (not shown) to camshaft 5, is further transmitted to drive cam 5*a*. When drive cam 5*a* rotates eccentrically to the axis X of camshaft 5, in other words, when the axis Y of drive cam 5*a* revolves around the axis X of camshaft 5, link arm 21 converts eccentric motion of drive cam 5*a* into reciprocating motion (or oscillating motion). The reciprocating motion (the oscillating motion, in other words, oscillating force) is transmitted via link arm 21 to rocker arm 23.

Owing to the reciprocating motion (the oscillating motion) transmitted from link arm 21 to rocker arm 23, rocker arm 23 oscillates on control cam 30, which is the pivot of oscillating motion of rocker arm 23. The oscillating force (oscillating motion) is transmitted from rocker arm 23 via the adjusting mechanism containing an adjusting screw 26 (described later) to link member 24, in that order. The transmitted oscillating force (transmitted oscillating motion) is further transmitted from link member 24 to the common connecting shaft 18 and simultaneously transmitted to valve actuation members 8, 8. As a result, the oscillating motions of the two valve actuation members 8, 8 are synchronized to each other.

Valve actuation members 8, 8 oscillate on the respective coaxial shaft portions 29*a*, 29*a* through the fitting holes 19*a*, 19*a* of pivoting portions 19, 19. During the oscillating motion of each valve actuation member 8, the cam surfaces 20*a*, 20*a* of cam portions 20, 20 roll the outer peripheries of rollers 15, 15 within the designated cam-surface area, ranging from the base to the thin-walled tip and including lift surface 20*b* and base-circle surface 20*c*, while the cam surfaces 20*a*, 20*a* force the respective rollers 15, 15 of swing arms 6, 6 downwards against the spring forces of valve springs 13, 13. As a result of this, intake valves 3, 3 are opened and closed, that is, the synchronous drive of two intake valves 3, 3 can be achieved.

Figure 6:
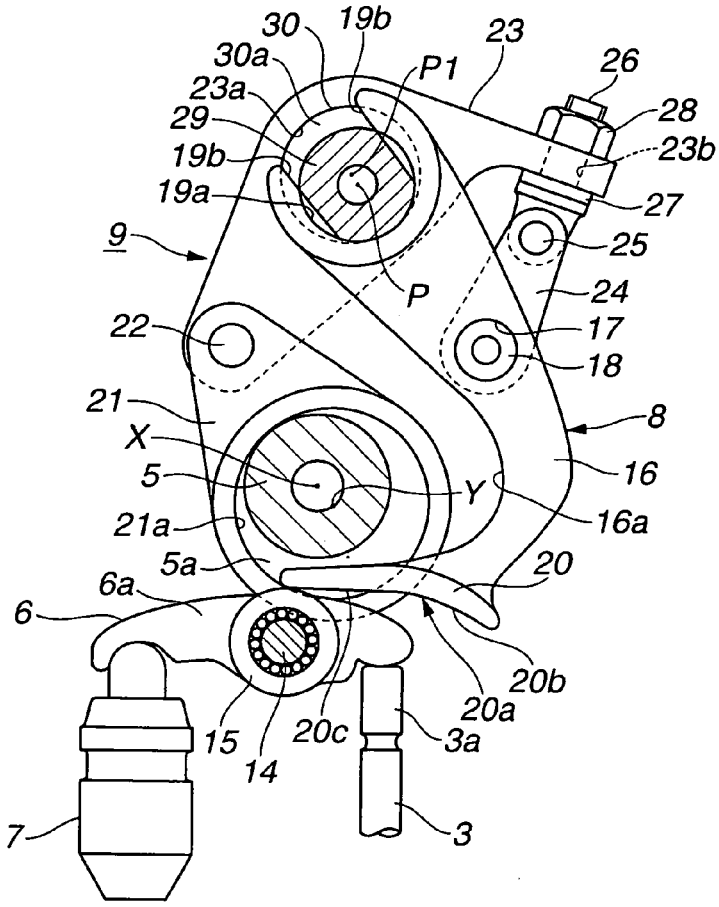
FIG. 6 is an explanatory drawing showing the operation of the valve operating apparatus of the first embodiment during minimum valve lift control.

The operation of variable valve lift mechanism 9, incorporated in the apparatus of the first embodiment, is hereunder described in detail. In a low-speed low-load range, for example, when the engine is idling, the processor of control unit 32 detects or determines, based on input information from the engine/vehicle sensors, that the engine is conditioned in a low-speed low-load state. The motor of actuator 31 is driven responsively to. a control command signal determined based on the latest up-to-date informational data signals generated from the engine/vehicle sensors and indicative of the low-speed low-load state. Therefore, control shaft 29 is rotated and adjusted to a desired angular position suited to the current engine operating condition, i.e., the low-speed low-load operation. As seen from the side views of FIGS. 1 and 6, the axis P1 of control cam 30 is displaced to a position above the axis P of control shaft 29, and thus the thick-walled portion 30*a* of control cam 30 is displaced and held at the upper left position with respect to the axis P of control shaft 29. (see FIG. 6). As a result of this, the attitude/position of rocker arm 23 changes or shifts or displaces in a direction of displacement of the thick-walled portion 30*a* of control cam 30 via cam hole 23*a*, and whereby the attitude/position of rocker arm 23 becomes adjusted to and held at a position spaced apart from each of valve actuation members 8, 8 (viewing FIGS. 1 and 6).

Thus, valve actuation members 8, 8 are slightly rotated on the respective coaxial shaft portions 29*a*, 29*a* (the pivots) in their counterclockwise directions, such that the internal surfaces 16*a*, 16*a* of arcuate portions 16, 16 of valve actuation members 8, 8 are displaced and spaced apart from the outer periphery of camshaft 5. As a result, the contact area of each of the cam surfaces 20*a*, 20*a* of cam portions 20, 20 in rolling-contact with the respective rollers 15, 15 of swing arms 6, 6, is shifted from the substantially central concave portion of cam surface 20*a* towards the base-circle surface 20*c* (i.e., leftwards in the side view shown in FIG. 1). Therefore, the valve lift amount of each of intake valves 3, 3 is adjusted to a small lift amount, thereby achieving reduced fuel consumption rate and stabilized engine speeds.

Figure 7:
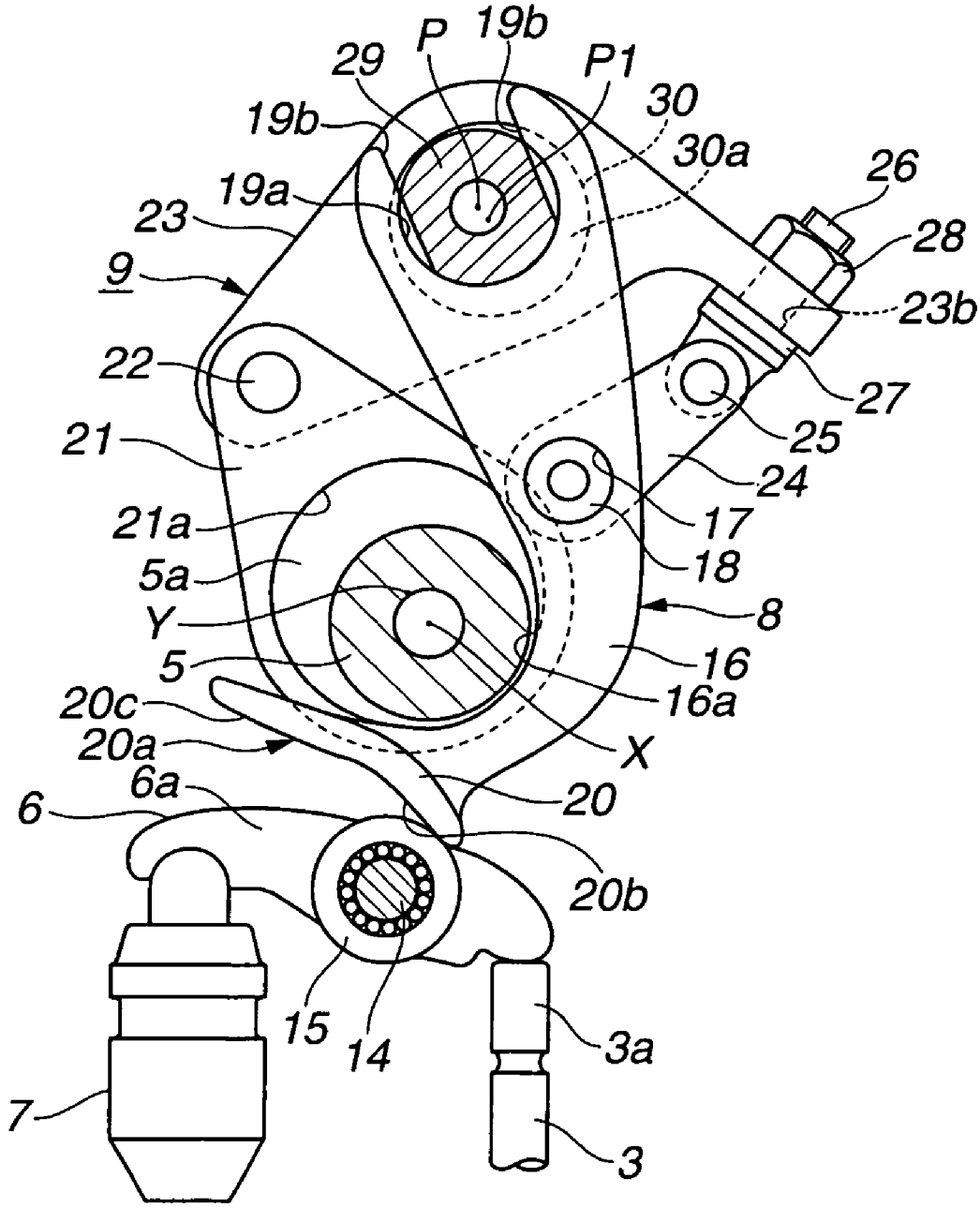
FIG. 7 is an explanatory drawing showing the operation of the valve operating apparatus of the first embodiment during maximum valve lift control.

In contrast, when shifting to a high-speed high-load range, the motor of actuator 31 is driven responsively to a control command signal determined based on the latest up-to-date sensor signals and indicative of the high-speed high-load state. Therefore, control shaft 29 is rotated clockwise from the angular position shown in FIGS. 1 and 6 to the angular position (see FIG. 7) suited to the current engine operating condition, i.e., the high-speed high-load operation. As seen from the side view of FIG. 7, the axis P1 of control cam 30 is displaced to a position below the axis P of control shaft 29, and thus the thick-walled portion 30*a* of control cam 30 is displaced and held at the lower right position with respect to the axis P of control shaft 29. As a result of this, the attitude/position of rocker arm 23 shifts or displaces in a direction of displacement of the thick-walled portion 30*a* of control cam 30, and whereby the attitude/position of rocker arm 23 becomes adjusted to and held at a position displaced close to the upper ends of valve actuation members 8, 8 (viewing FIG. 7).

Thus, valve actuation members 8, 8 are slightly rotated on the respective coaxial shaft portions 29*a*, 29*a* (the pivots) in their clockwise directions, such that the internal surfaces 16*a*, 16*a* of arcuate portions 16, 16 of valve actuation members 8, 8 are displaced towards positions close to the outer periphery of camshaft 5. At this time, by means of the internal surfaces 16*a*, 16*a* of arcuate portions 16, 16, configured to substantially conform to the curvature of the outer periphery of camshaft 5, clockwise movement of each of valve actuation members 8, 8 is cushionedly restricted or limited or absorbed, such that shock load or strong collision or strong interference between camshaft 5 and each valve actuation member 8 can be certainly avoided. Due to the clockwise displacement of valve actuation members, the contact area of each of the cam surfaces 20*a*, 20*a* of cam portions 20, 20 in rolling-contact with the respective rollers 15, 15 of swing arms 6, 6, is shifted from the substantially central concave portion of cam surface 20*a* towards the lift surface 20*b* (i.e., rightwards in the side view shown in FIG. 7). Therefore, the valve lift amount of each of intake valves 3, 3 is adjusted to a large lift amount, thereby achieving enhanced engine power output.

As set forth above, in the valve operating apparatus of the first embodiment shown in FIGS. 1-7, rocker arm 23 is using control cam 30 (fixed to control shaft 29) as the fulcrum of oscillating motion of rocker arm 23, whereas valve actuation members 8, 8 are using the respective coaxial shaft portions 29*a*, 29*a* of the same control shaft 29 as their pivots (the fulcrums of oscillating motions of valve actuation members 8, 8). As already described, the axis P1 of control cam 30 radially deviates from the axis P of control shaft 29 by a predetermined eccentricity (i.e., a distance between the axes P and P1), and control cam 30 is formed integral with control shaft 29 so that the axis P1 of control cam 30 and the axis P of control shaft 29 are laid out in close proximity to each other. Therefore, after installation of the valve operating apparatus on the engine cylinder head, it is possible to certainly prevent a relative-position relationship between the fulcrum of oscillating motion of rocker arm 23 and the fulcrum of oscillating motion of each valve actuation member 8 from undesirably deviating from a preset normal relative-position relationship. Thus, it is possible to provide a desired valve lift characteristic (or a design valve-lift characteristic) of each of intake valves 3, 3 without being affected by each individual component-part's machining accuracies and/or installation error of the multi-link mechanism after assembling. Additionally, the fulcrum of oscillating motion of rocker arm 23 and the fulcrum of oscillating motion of valve actuation member 8 are laid out in close proximity to each other, and thus, the degree of freedom in layout of the drive shaft (camshaft 5) itself is high.

Additionally, in the valve operating apparatus of the first embodiment, it is possible to compactly install or lay out each of valve actuation members 8, 8 within a limited space in a such a manner as to bypass the outer periphery of camshaft 5 by virtue of the respective arcuate portions 16, 16. Therefore, the existing camshaft-to-cylinder head layout can be easily applied or utilized to the layout of camshaft 5 with respect to cylinder head 1 in the valve operating apparatus of the first embodiment employing the multi-link type variable valve lift mechanism. Also, by virtue of arcuate portions 16, 16, each of the overall height and the overall width of the apparatus can be reduced to as small a dimension as possible.

Valve actuation members 8, 8 are mechanically linked via swing arms 6, 6 to the respective stem ends 3*a*, 3*a* of intake valves 3, 3, while bypassing the outer periphery of camshaft 5 by virtue of arcuate portions 16, 16. Thus, it is unnecessary to greatly modify or change the mutual-position relationship and layout of camshaft 5 with respect to cylinder head 1 from the existing camshaft-to-cylinder head layout (the existing camshaft-to-cylinder head mutual-position relationship). That is, by way of efficiently concentrated layout of valve actuation members 8, 8 and variable valve lift mechanism 9 near camshaft 5, it is possible to provide a desired variable valve lift function without greatly changing the existing camshaft-to-cylinder head layout. As a result of this, it is possible to realize lower valve operating system installation time and costs and smaller space requirements of overall system.

Furthermore, in the valve operating apparatus of the first embodiment, almost all of valve actuation members 8, 8 and variable valve lift mechanism 9 are compactly laid out mainly above camshaft 5. Thus, component parts of the valve operating apparatus, in particular, valve actuation members 8, 8 and a plurality of links (21, 23, 24, 29, 30) constructing variable valve lift mechanism 9, cannot interfere easily with a spark plug of a typical cylinder head and intake and exhaust ports of a high-port cylinder head suitable to high performance engines. That is, the valve operating apparatus of the first embodiment permits the engine performance to be effectively enhanced by way of high-port machining or high-port forming of engine-valve ports, in particular, intake-valve ports.

Actually, in order to lay out valve actuation members 8, 8 and variable valve lift mechanism 9 above camshaft 5 serving as the drive shaft, it is preferable to lay out control shaft 29 above the drive shaft (camshaft 5) in a substantially vertical direction. More concretely, in the case of the internal combustion engine with the spark plug (not shown) installed on the left-hand side of each intake valve 3 in FIGS. 1 and 13 and the high-ported cylinder head having the substantially vertical intake port produced by high-port machining or high-port forming of each intake port 2 located in the lower right portion in FIGS. 1 and 13, the space defined above the cylinder head becomes narrow. Efficiently laying out valve actuation members 8, 8 and variable valve lift mechanism 9 within the narrow limited space without changing the existing camshaft-to-cylinder head layout as much as possible, can be achieved by laying out control shaft 29 above the drive shaft (camshaft 5), that is, the improved multi-link layout of the valve operating apparatus of the first embodiment. The improved multi-link layout avoids various drawbacks, such as a great modification from the existing cylinder-head construction, and more complicated cylinder head construction. That is, the improved multi-link layout permits utilization of the existing camshaft-to-cylinder head layout, thus remarkably reducing manufacturing costs.

In recent years, an internal combustion engine often employs a variable valve timing control (VTC) system (a phase control system) as well a variable valve lift control system. In the VTC equipped engine, to vary an angular phase between the crankshaft and the camshaft, a variable valve timing mechanism is interleaved between the drive shaft (camshaft 5) and a large-diameter sprocket (not shown) driven by the crankshaft and installed coaxially on the axis of the drive shaft. In such a case, suppose that the drive shaft (camshaft 5) is laid out above control shaft 29. Owing to the large-diameter sprocket coaxially arranged on the drive shaft laid out above control shaft 29, in other words, owing to the comparatively large axial offset of the sprocket and the control shaft (exactly, the comparatively large offset between the rotation axis of the sprocket and the rotation axis P of control shaft 29), the overall height of the internal combustion engine becomes undesirably high.

For the reasons set out above, in the valve operating apparatus of the first embodiment shown in FIGS. 1-7, control shaft 29 is laid out above the drive shaft (camshaft 5) in the substantially vertical direction. Thus, the overall height of the engine is effectively reduced or suppressed to a low height as much as possible by laying out control shaft 29 above camshaft 5. In other words, the sprocket (or the pulley) having a driving connection with camshaft 5 can be compactly laid out within the limited space defined by the maximum height and the maximum width of the variable valve operating apparatus.

That is to say, according to the improved multi-link layout of the valve operating apparatus of the first embodiment, as discussed previously, the distance between the axis X of camshaft 5 and the axis of roller shaft 14 of roller 15 of each swing arm 6, spaced apart from camshaft 5, is dimensioned to be adequately shorter than the distance between the axis P of control shaft 29 and the axis of roller shaft 14. And thus, camshaft 5 (the drive shaft) does not need to greatly deviate from rollers 15, 15 (cam followers) of swing arms 6, 6. Thus, it is unnecessary to greatly modify or change the mutual-position relationship and layout of a sprocket (or a pulley), having a driving connection with camshaft 5, with respect to a chain, having a driving connection with the sprocket (or the pulley), from the existing sprocket (pulley)-to-chain layout. Thus, according to the improved multi-link layout, it is possible to prevent undesirable large-sizing of the engine and deteriorated layout of the valve operating mechanism.

In the shown embodiment, when comparing the distance from camshaft 5 to swing arm 6 with the distance from control shaft 29 to swing arm 6, as a reference, the camshaft-axis X and the axis of roller shaft 14 of roller 15 (the cam follower) are used. In lieu thereof, the shortest distance between the outer peripheral surface of camshaft 5 and the outer peripheral surface of roller shaft 14 may be compared to the shortest distance between the outer peripheral surface of control shaft 29 and the outer peripheral surface of roller shaft 14. As a reference, another arbitrary positions of camshaft 5 and swing arm 6 may be selected.

Additionally, in the valve operating apparatus of the first embodiment, the extension of cam portion 20, which ranges from the substantially central concave portion of cam surface 20*a* to the thin-walled tip (the leftmost end in FIG. 1) and has base-circle surface 20*c* and has a relatively small rigidity, is configured to provide a minimum valve lift amount. On the other hand, the base of cam portion 20, which is formed integral with the lower end of arcuate portion 16 and has lift surface 20*b* and has a relatively large rigidity, is configured to provide a maximum valve lift amount. Such proper setting of the wall thickness of cam portion 20 contributes to (i) reliable spring-load receiving performance for spring load (spring force), which tends to increase substantially in proportion to a valve-lift increase of each of intake valves 3, 3, (ii) light weight for each valve actuation member, (iii) less wear of the rolling-contact portion between roller 15 and cam surface 20*a*, and (iv) enhanced durability of the valve operating apparatus.

Furthermore, in the valve operating apparatus of the first embodiment, during valve-opening of each intake valve 3, that is, when cam surface 20*a* of cam portion 20 forces swing arm 6 downwards via lift surface 20*b*, on the one hand, the reaction force of valve spring 13 is transmitted through pivoting portion 19 of valve actuation member 8 and then acts diagonally to the upper right of control shaft 29 in a direction of connecting pin 22. On the other hand, a cam lift force of drive cam 5*a* is transmitted through link arm 21 and rocker arm 23, and then acts diagonally to the lower left portion of control shaft 29 in the direction substantially opposite to the direction of action of the reaction force applied to control shaft 29 and caused by the valve spring force. Therefore, the reaction force acting on control shaft 29 and the cam lift force acting on the same control shaft are canceled each other, thus effectively avoiding undesirably excessive load application to control shaft 29 and ensuring a less load acting on control shaft 29. That is, the magnitude of bending moment acting on control shaft 29 becomes very small. This contributes to small-sizing and lightweight of control shaft 29, and also to small-sizing of electric actuator 31.

In addition to the above, two valve actuation members 8, 8 per cylinder are linked to each other in such a manner as to oscillate by means of one drive cam (a common drive cam) 5*a*. The valve operating apparatus of the first embodiment is simple in construction.

Additionally, as already described, valve actuation members 8, 8 are arranged symmetrically with respect to drive cam 5*a* (see FIG. 2). The spring forces produced by valve springs 13, 13 act uniformly on respective valve actuation members 8, 8 through stem ends 3*a*, 3*a* of intake valves 3, 3. This prevents undesirable inclination/torsion of the multi-link mechanism constructing a part of the valve operating apparatus, thus preventing positive and negative fluctuations in lift amounts of intake valves 3, 3.

Additionally, pivoting portions 19, 19 of valve actuation members 8, 8 are supported by the lower part of control shaft 29 but not by the entire circumference of control shaft 29. In other words, pivoting portion 19 of valve actuation member 8 has an opening end for easy installation. And thus, each of valve actuation members 8, 8 can be easily installed on or attached to control shaft 29 from under the outer periphery of control shaft 29.

Additionally, the spring forces created by valve springs 13, 13 are supported or received by control shaft 29 via pivoting portions 19, 19 of valve actuation members 8, 8. In spite of the simplified spring-force support structure, it is possible to effectively reduce the bearing stress of the internal surface (the supporting surface or the bearing surface) of each of fitting holes 19*a*, 19*a*, thus reducing undesirable wear of the bearing surface.

Additionally, each of valve actuation members 8, 8 oscillates on control shaft 29 serving as the pivot, and thus cam surface 20*a* draws a circular arc during operation of the engine. Therefore, it is possible to create an accurate base circle of zero valve lift at the side of base-circle surface 20*c* of cam surface 20*a*, and thus to stably restrict the height of hydraulic lash adjuster 7.

Furthermore, valve actuation members 8, 8 are pushed toward control shaft 29 by the respective hydraulic lash adjusters 7, 7 via pivoting portions 19, 19, thereby ensuring easy assembling of each of valve actuation members 8, 8 on control shaft 29.

Moreover, properly changing the thickness of shim 27 of the adjusting mechanism, allows extremely small adjustments for the valve lift amount of each intake valve 3 via each cam surface 20*a* to be made. Thus, it is possible to prevent an undesired difference between valve lift amounts of two intake valves 3, 3 included in the same engine cylinder and to prevent an undesired difference between valve lift amounts of intake valves included in the two different engine cylinders. This contributes to reduced fuel consumption rate and stabilized engine speeds.

Figure 8:
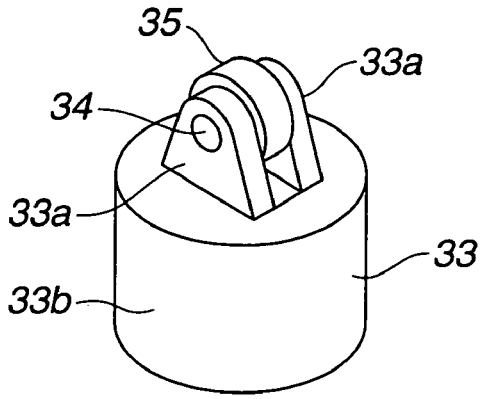
FIG. 8 is a perspective view showing a direct-acting valve lifter, which is applicable to a modified valve operating apparatus.
Figure 9:
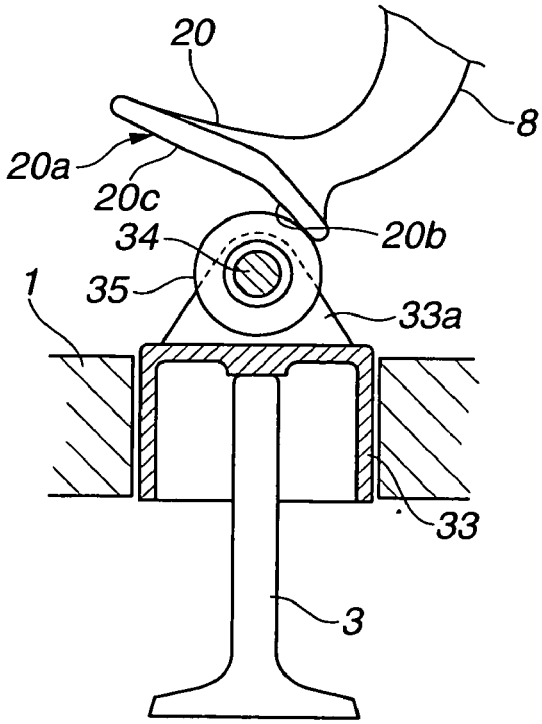
FIG. 9 is a cross-sectional view showing the essential part of the modified valve operating apparatus employing the direct-acting valve lifter, under an abutted-engagement state where the valve actuation member and the direct-acting valve lifter of FIG. 8 are in abutted-engagement with each other.

Referring now to FIGS. 8-9, there is shown the modified valve operating apparatus using a direct-acting valve lifter 33 instead of using swing arms 6, 6 and hydraulic lash adjusters 7, 7. As can be seen from FIGS. 8-9, direct-acting valve lifter 33 is mainly comprised of a hollow-cylinder housing 33*b* closed at one end, a pair of substantially triangular support brackets 33*a*, 33*a* formed integral with the top face of housing 33*b*, and a roller 35. Roller 35 is rotatably supported by a roller shaft 34 via a needle bearing (not shown). Both ends of roller shaft 34 are fitted to respective support brackets 33*a*, 33*a*. Cam surface 20*a* of cam portion 20 of valve actuation member 8 is in rolling-contact with the outer peripheral surface of roller 35. That is, roller 35 serves as a cam follower for cam portion 20. The modified valve operating apparatus of FIGS. 8-9, replacing swing arms 6, 6 and hydraulic lash adjusters 7, 7 with direct-acting valve lifter 33, is simple in construction rather than that of the first embodiment of FIGS. 1-7. This further reduces manufacturing costs.

Figure 10:
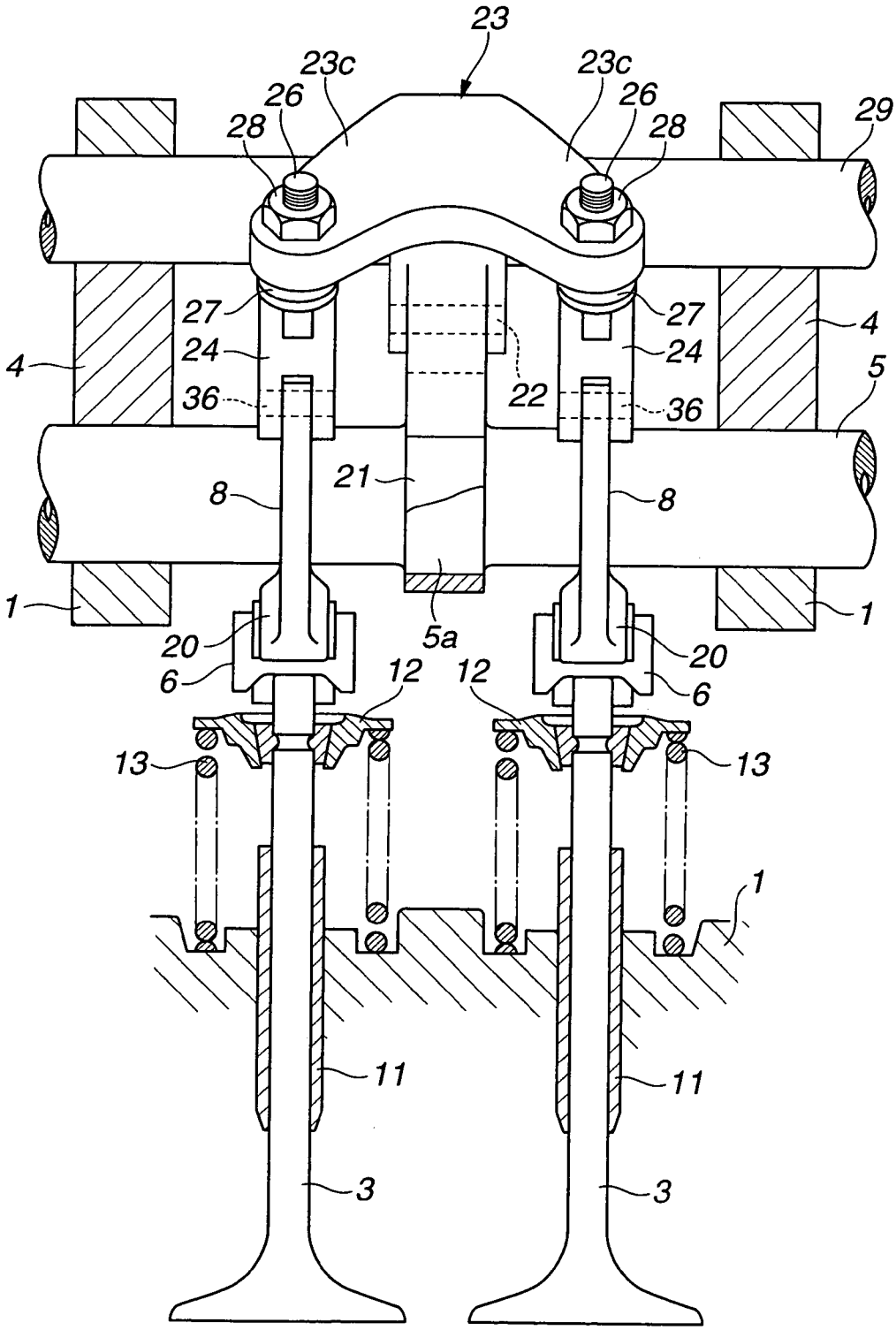
FIG. 10 is an elevation view showing a second embodiment of a variable valve operating apparatus, partly cross-sectioned.
Figure 11:
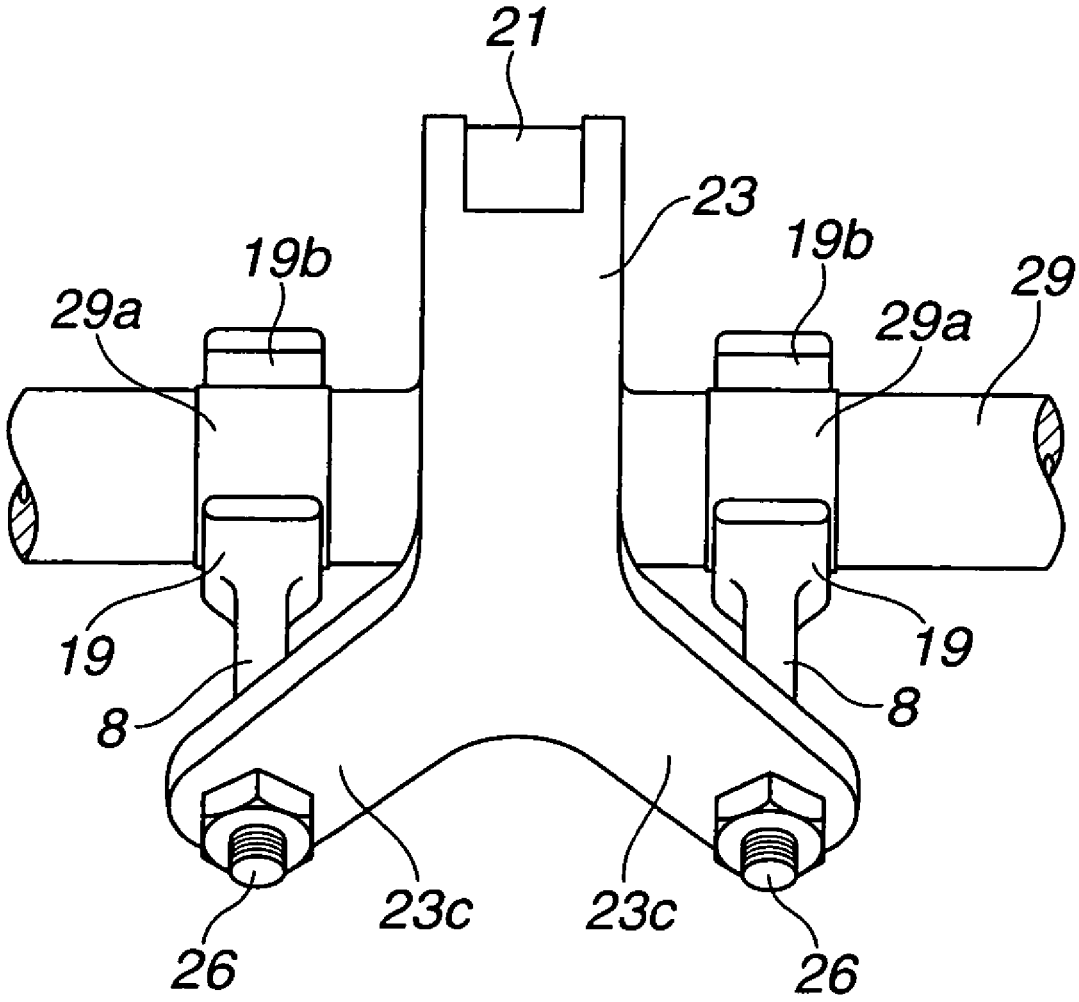
FIG. 11 is a plan view showing the essential part of the valve operating apparatus of the second embodiment shown in FIG. 10.

Referring now to FIGS. 10-11, there is shown the valve operating apparatus of the second embodiment, in which connecting shaft 18 common to two valve actuation members 8,8 is eliminated and in lieu thereof the second end 23*c* of rocker arm 23 is formed as a forked end comprised of two branches. The two branches of the forked end (the second end 23*c*) of rocker arm 23 are provided with respective adjusting mechanisms (26, 27, 28; 26, 27, 28). Thus, the two branches of the forked end (the second end 23*c*) of rocker arm 23 are rotatably (or pivotably) linked via respective link members 24, 24 to valve actuation mechanisms 8, 8. Additionally, in the second embodiment, link member 24 is formed of metal material by way of press molding and formed into a substantially H shape, so that link member 24 has upper and lower forked ends. In a similar manner to the first embodiment, the upper forked end of link member 24 of the valve operating apparatus of the second embodiment is pin-connected to the D-shaped tab-like portion of head 26*a* of the adjusting mechanism. On the other hand, the lower forked end of link member 24 is rotatably linked to the substantially center portion of the associated valve actuation member 8 by means of a short connecting pin 36, so that the substantially center portion of valve actuation member 8 is sandwiched by the two parallel plate-shaped portions of the lower forked end of link member 24. Therefore, the valve operating apparatus of the second embodiment of FIGS. 10-11 can provide the same operation and effects (e.g., the simplified total construction of the valve operating system) as the first embodiment of FIGS. 1-7, by means of the single control cam 30. In particular, in the apparatus of the second embodiment, valve actuation members 8, 8 are linked to each other through respective adjusting mechanisms (26, 27, 28; 26, 27, 28) and link members 24, 24 to rocker arm 23, rather than through the common connecting shaft 18. This enables independent extremely-small-adjustments for valve lifts of two intake valves 3, 3 installed in the same cylinder by means of the two adjusting mechanisms individually linked to respective valve actuation members 8, 8. As a result of this, it is possible to more effectively reduce or minimize the difference between valve lift amounts of intake valves 3, 3 included in the same cylinder.

Figure 12:
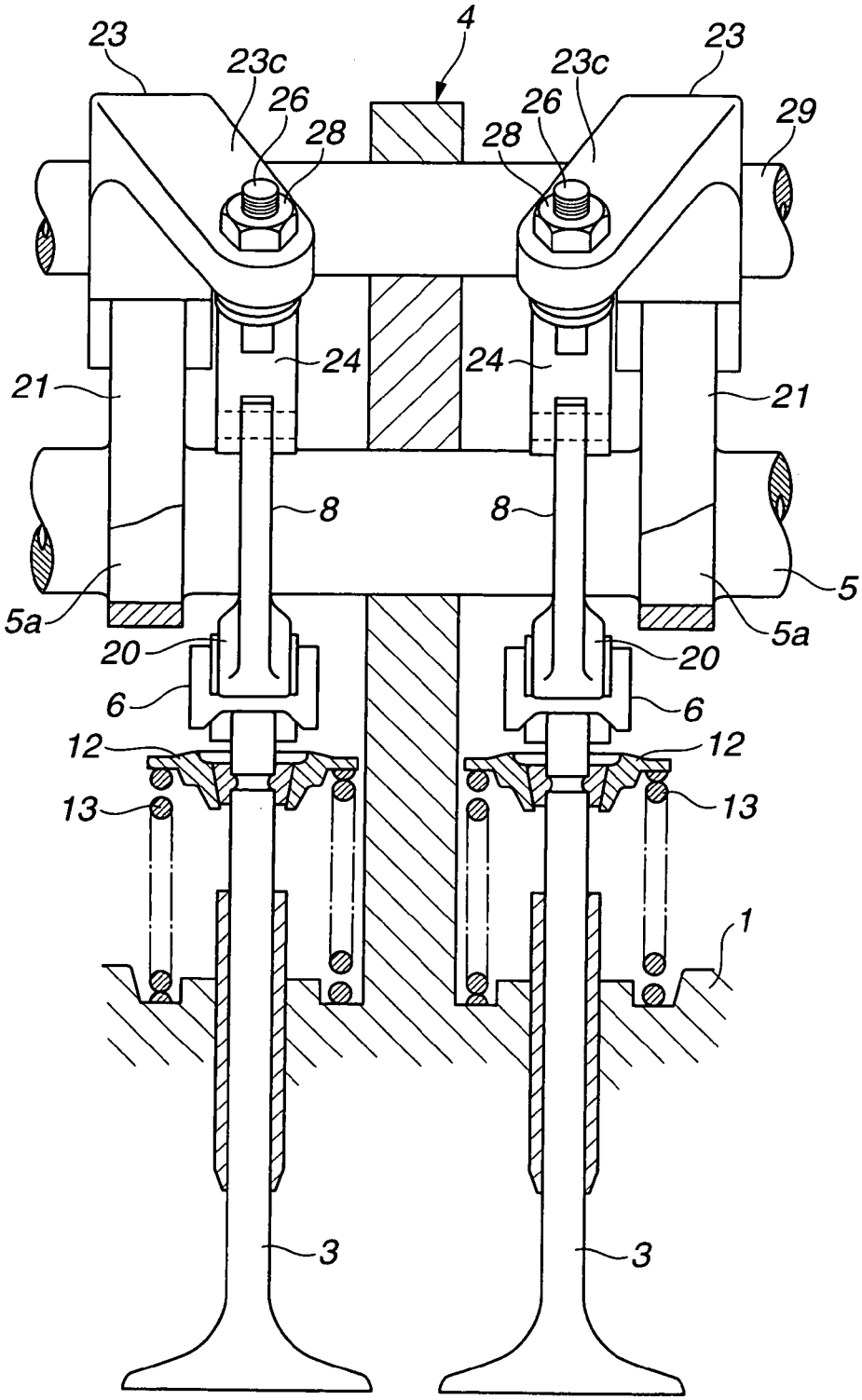
FIG. 12 is an elevation view showing a third embodiment of a variable valve operating apparatus, partly cross-sectioned.

Referring now to FIG. 12, there is shown the valve operating apparatus of the third embodiment. The valve operating apparatus of the third embodiment of FIG. 12 is similar to that of the second embodiment of FIGS. 10-11, except that, in the third embodiment, two drive cams 5*a*, 5*a* per cylinder are integrally formed with the outer periphery of camshaft 5, two link arms 21, 21 are rotatably linked to respective drive cams 5*a*, 5*a*, and two rocker arms 23, 23 are rotatably linked to respective link arms 21, 21 via connecting pins 22, 22. Thus, the same reference signs used to designate elements in the apparatus of the second embodiment shown in FIGS. 10-11 will be applied to the corresponding reference signs used in the third embodiment shown in FIG. 12, for the purpose of comparison of the second and third embodiments. The flattened second ends 23*c*, 23*c*, extending from the respective center sections of left and right rocker arms 23, 23 (viewing in FIG. 12) having cam holes 23*a*, 23*a*, are slightly inclined such that the tips of the second ends 23*c*, 23*c* of rocker arms 23, 23 gradually approach mutually. The second ends 23*c*, 23*c* of left and right rocker arms 23, 23 are provided with respective adjusting mechanisms (26, 27, 28; 26, 27, 28). Thus, the second ends 23*c*, 23*c* of left and right rocker arms 23, 23 are rotatably (or pivotably) linked via respective link members 24, 24 to valve actuation mechanisms 8, 8. As discussed above, rocker arms 23, 23 are separated from each other, and thus one bearing block 4, used to rotatably support control shaft 29 as well as camshaft 5, is laid out between rocker arms 23, 23. Therefore, in the same manner as the second embodiment, the valve operating apparatus of the third embodiment enables independent extremely-small-adjustments for valve lifts of two intake valves 3, 3 installed in the same cylinder by means of the two adjusting mechanisms individually linked to respective valve actuation members 8, 8. Drive cams 5*a*, 5*a* are linked to respective intake valves independently of each other. Thus, it is possible to individually set the valve lift characteristics of intake valves 3, 3 by arbitrarily setting respective cam profiles of drive cams 5*a*, 5*a*.

As set forth above, the flattened second ends 23*c*, 23*c*, extending from the respective center sections of left and right rocker arms 23, 23 are slightly inclined and offset from the rocker-arm center sections in the axial direction of control shaft 29, such that the tips of the second ends 23*c*, 23*c* of rocker arms 23, 23 gradually approach mutually. Even when the oscillating forces (oscillating loads) are transmitted from drive cams 5*a*, 5*a* through link arms 21, 21 to the first ends opposing to the second ends 23*c*, 23*c* of rocker arms 23, 23, the oscillating forces can be stably received or supported by the rocker-arm central sections whose axial width is greater than that of the second ends of rocker arms 23, 23. This prevents or minimizes undesirable rattling motion of each rocker arm 23 in the axial direction.

Additionally, in the valve operating apparatus of the third embodiment of FIG. 12, bearing block 4 can be laid out substantially midway between rocker arms 23, 23, and thus the rigidity of the supporting structure for control shaft 29 is high. By virtue of the high rigidity of the control-shaft supporting structure, it is possible to adequately prevent or suppress the undesirable deflection and vibrations of control shaft 29, arising from oscillating load transmitted from drive cams 5*a*, 5*a* via link arms 21, 21 to rocker arms 23, 23 and spring forces of valve springs 13, 13. This effectively suppresses a deviation of the valve lift characteristic of each of intake valves 3, 3, which may occur owing to the undesirable deflection of control shaft 29.

Referring now to FIGS. 13-18, there is shown the valve operating apparatus of the fourth embodiment, in which a first pair of drive cams 5*a*, 5*a* associated with a first one of intake valves 3, 3 included in the same cylinder and a second pair of drive cams 5*a*, 5*a* associated with the second intake valve are integrally formed with the outer periphery of camshaft 5, and the cam profile of each drive cam 5*a* is formed into a raindrop shape. A first pair of control cams 30, 30, associated with the first intake valve and axially spaced from each other a predetermined distance, and a second pair of control cams 30, 30, associated with the second intake valve and axially spaced from each other a predetermined distance, are integrally formed with control shaft 29. A first coaxial shaft portion 29*a* is formed integral with control shaft 29 and laid out between the first pair of control cams 30, 30. In a similar manner, a second coaxial shaft portion 29*a* is formed integral with control shaft 29 and laid out between the second pair of control cams 30, 30. The first and second coaxial shaft portions 29*a*, 29*a* are arranged coaxially with (or concentrically with) the rotation axis P of control shaft 29.

On the other hand, each of rocker arms 23, 23 is formed of metal material by way of press molding and curved into a substantially U shape in cross section. Each of rocker arms 23, 23 is formed integral with substantially circular-arc shaped sidewall portions. Each of the circular-arc shaped rocker-arm sidewall portions is gradually widened from the first end (the lower end) to the second end (the upper end). A first pair of rollers 40, 40, associated with the first intake valve 3, are rotatably mounted on the first end (the lower end) of the left-hand rocker arm 23 via a roller shaft 41, so that the first pair of rollers are arranged outside of the respective sidewall portions of the left-hand rocker arm 23 and that the first pair of rollers 40, 40 are in rolling contact with the outer peripheral surfaces of the first pair of drive cams 5*a*, 5*a*. In a similar manner, a second pair of rollers 40, 40, associated with the second intake valve 3, are rotatably mounted on the first end (the lower end) of the right-hand rocker arm 23 via a roller shaft 41, so that the second pair of rollers are arranged outside of the respective rocker-arm sidewall portions of the right-hand rocker arm 23 and that the second pair of rollers 40, 40 are in rolling contact with the outer peripheral surfaces of the second pair of drive cams 5*a*, 5*a*. A first pair of circular large-diameter cam holes 42, 42 are bored in the sidewall portions of the second end (the upper end) of the left-hand rocker arm 23, such that the first pair of control cams 30, 30, associated with the first intake valve, are fitted to the first pair of cam holes 42, 42 of the left-hand rocker arm 23. In a similar manner, a second pair of circular large-diameter cam holes 42, 42 are bored in the sidewall portions of the second end (the upper end) of the right-hand rocker arm 23, such that the second pair of control cams 30, 30, associated with the second intake valve, are fitted to the second pair of cam holes 42, 42 of the right-hand rocker arm 23. Thus, the left-hand rocker arm 23 is oscillatingly or rockably supported on the left-hand control cam pair of control shaft 29 by way of cam-connection between the first pair of control cams 30, 30 and the first pair of cam holes 42, 42, whereas the right-hand rocker arm 23 is oscillatingly or rockably supported on the right-hand control cam pair of control shaft 29 by way of cam-connection between the second pair of control cams 30, 30 and the second pair of cam holes 42, 42.

Figure 15:
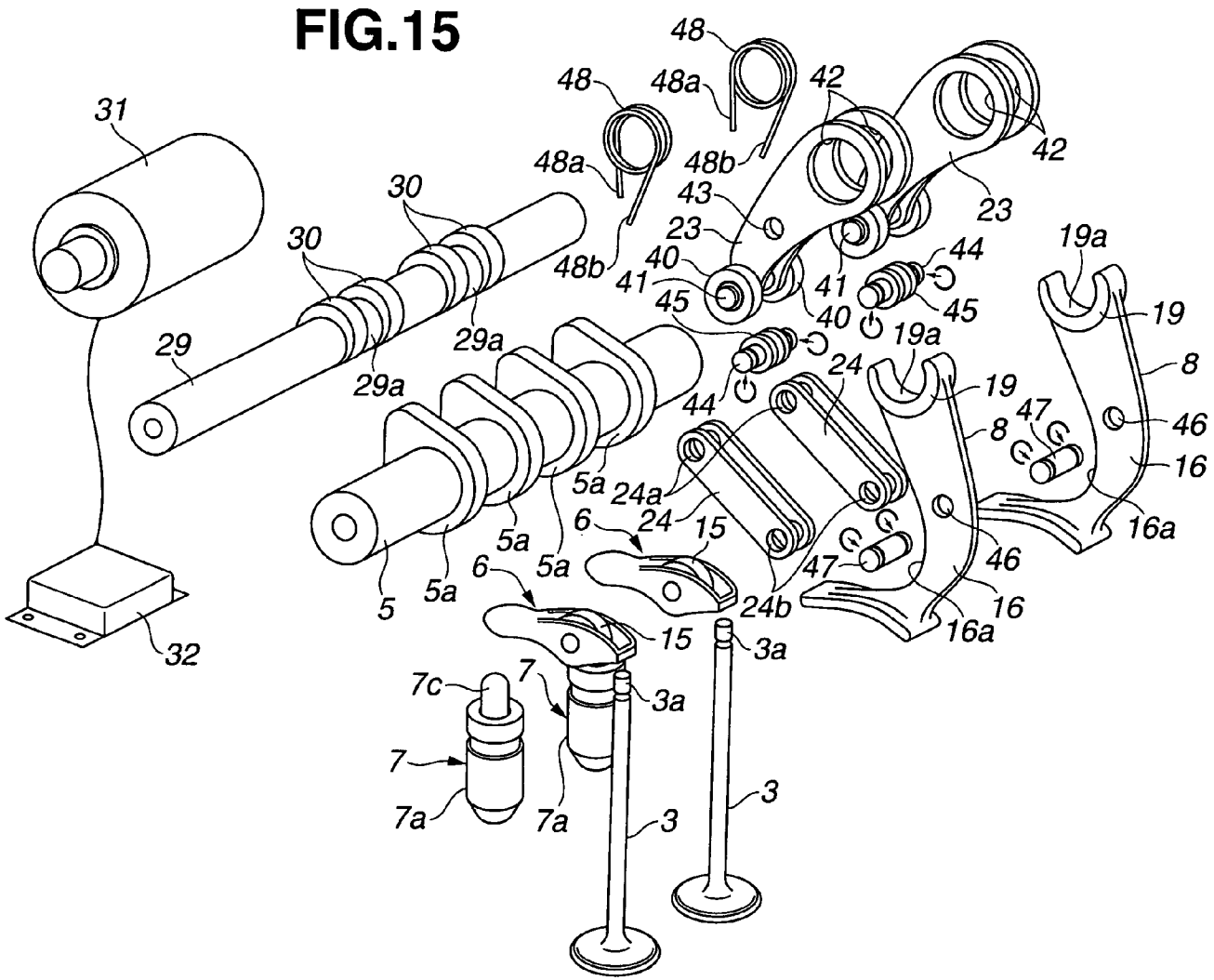
FIG. 15 is a disassembled view of component parts constructing the valve operating apparatus of the fourth embodiment shown in FIGS. 13-14.
Figure 16:
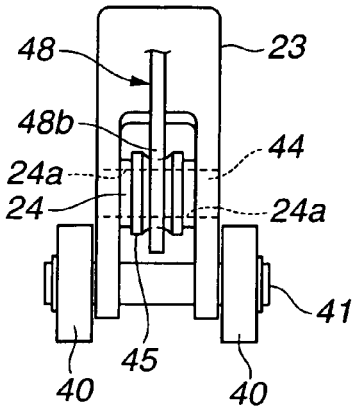
FIG. 16 is an elevation view showing the essential part of the valve operating apparatus of the fourth embodiment, under a spring-loaded state where a roller is spring-loaded by means of a torsion spring.

Additionally, as best seen in FIGS. 15-16, an annular-grooved support roller 45 is rotatably attached to the substantially center of each of rocker arms 23, 23, such that support roller 45 is rotatably provided between the rocker-arm sidewall portions. The sidewall portions are formed at their substantially centers with through holes 43, 43 into which both ends of a first connecting pin (a first pivot pin) 44 are fitted. Support roller 45 is rotatably supported on the center of the first connecting pin 44.

The substantially lower half of each of valve actuation members 8, 8 is formed as an arcuate portion 16, which is curved in a manner so as to bypass the outer periphery of camshaft 5. As can be seen from comparison between the side views of FIG. 1 (the first embodiment) and FIG. 13 (the fourth embodiment), in the apparatus of the fourth embodiment, the upper pivoting portion (or the pivotal-fitting portion) 19 of valve actuation member 8, to be pivotably fitted to control shaft 29, is formed with a circular-arc shaped fitting groove 19*a*, but not formed with two opposing cut-out portions 19*b*, 19*b*. The inside dimension of the opening end of pivoting portion 19 (fitting groove 19*a*) is dimensioned to be slightly greater than the outside diameter of control shaft 29. The first and second coaxial shaft portions 29*a*, 29*a* of control shaft 29 pivotably support the respective upper ends of valve actuation members 8, 8 through the circular-arc shaped fitting grooves 19*a*, 19*a* whose inner peripheral surfaces are in sliding-contact with the respective coaxial shaft portions 29*a*, 29*a*. Each of valve actuation members 8, 8 is formed at its substantially center with a through hole 46. A second connecting pin (a second pivot pin) 47 is fitted to the through hole 46 for each individual valve actuation member 8.

Rocker arm 23 and valve actuation member 8 of the left-hand side are mechanically linked to each other via the left-hand link member 24 located inside of both of rocker arm 23 and valve actuation member 8 of the left-hand side. Likewise, rocker arm 23 and valve actuation member 8 of the right-hand side are mechanically linked to each other via the right-hand link member 24 located inside of both of rocker arm 23 and valve actuation member 8 of the right-hand side. Each of link members 24, 24 is formed of metal material by way of press molding and curved into a substantially U shape in lateral cross section. As best seen in FIG. 15, the two opposing sidewall portions of each of left and right link members 24, 24 are formed with a first set of through holes 24*a*, 24*a* and a second set of through holes 24*b*, 24*b*. Rocker arm 23 and valve actuation member 8 of the left-hand side are oscillatingly linked and pin-connected to each other via the inside link member 24 by means of connecting pins 44 and 47. Likewise, rocker arm 23 and valve actuation member 8 of the right-hand side are oscillatingly linked and pin-connected to each other via the inside link member 24 by means of connecting pins 44 and 47.

The first end of rocker arm 23 is permanently spring-loaded toward the associated drive cam 5*a*. That is, the pair of rollers 40, 40 are permanently forced into contact with the respective drive cams 5*a*, 5*a* by means of a torsion spring 48. Concretely, one spring end (a stationary end) 48*a* of torsion spring 48 is hanged and fixedly connected to the upper part of the intermediate bearing block 4*b* of the second bearing block 4 mounted on cylinder head 1. The other spring end (a spring-loading end) 48*b* is fitted into or engaged with the annular groove of support roller 45 under preload for rolling-contact between the other spring end 48*b* and support roller 45. Thus, as can be seen from the straight arrow drawn from the center of roller shaft 41 of one roller pair 40, 40 in the lower right direction in FIG. 13, rollers 40, 40 attached to the associated rocker arm 23 are permanently forced against the respective outer peripheral surfaces of drive cams 5*a*, 5*a*. At the same time, a component of spring force of torsion spring 48 acts on link member 24 via the annular-grooved support roller 45. As can be seen from the curved arrow drawn from the center of first connecting pin 44 in FIG. 13, link member 24 is pushed out in the upper right direction via the first connecting pin 44. At the same time, a component of spring force of torsion spring 48 acts on rocker arm 23 via the annular-grooved support roller 45 such that rocker arm 23 is forced against control cam 30. As can be seen from the straight arrow drawn from the axis (the rotation center P) of control shaft 29 in FIG. 13, rocker arm 23 is forced against the outer periphery of control cam 30 in the lower right direction via cam hole 42 and acts on valve actuation member 8 through the coaxial shaft portion 29*a* of control shaft 29.

In the same manner as the first, second, and third embodiments, in the valve operating apparatus of the fourth embodiment shown in FIGS. 13-18, the angular position of control shaft 29 can be adjusted by means of electric actuator 31 operated in response to a control command signal generated from control unit 32 and determined based on the latest up-to-date information concerning engine operating conditions.

With the previously-noted arrangement of the valve operating apparatus of the fourth embodiment of FIGS. 13-18, the opening and closing actions of each of intake valves 3, 3, are performed as follows. The actions are the same in left and right intake valves 3, 3 in the same cylinder. For the sake of simplicity in the following discussion, only the opening and closing actions of only one intake valve of intake valves 3, 3 included in the same cylinder are discussed hereunder.

When drive cams 5*a*, 5*a*, associated with the intake valve 3, rotate during rotation of camshaft 1, cam lift forces produced by drive cams 5*a*, 5*a* are transmitted to respective rollers 40, 40 of rocker arm 23 by virtue of a spring force of torsion spring 48, with the result that rocker arm 23 oscillates or pivots on the common axis P1 of the control cam pair 30, 30. The oscillating force (oscillating motion) of rocker arm 23 is transmitted via link member 24 to valve actuation member 8, and as a result valve actuation member 8 oscillates on the associated coaxial shaft portion 29*a* (the pivot of oscillating motion of valve actuation member 8) of control shaft 29.

Figure 13:
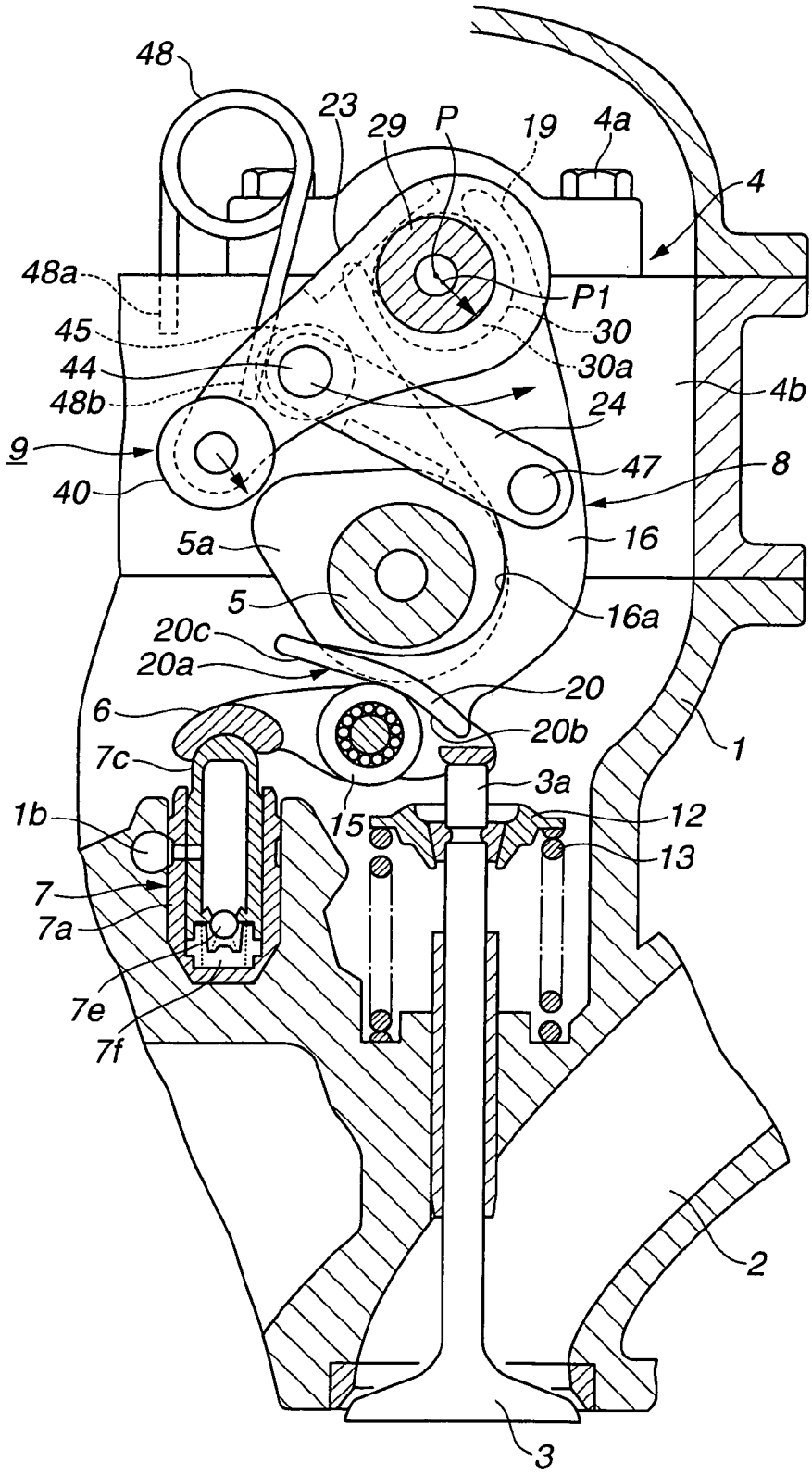
FIG. 13 is a side view showing a fourth embodiment of a variable valve operating apparatus, partly cross-sectioned.

In the apparatus of the fourth embodiment shown in FIG. 13, link member 24 is located inside of both of rocker arm 23 and valve actuation member 8 for linking them (23, 8). In lieu thereof, for the purpose of mechanical linking of rocker arm 23 and valve actuation member 8, link member 24 may be located outside of rocker arm 23 and valve actuation member 8. For instance, as shown in FIG. 1, link member 24 may be located outside of valve actuation member 8 for linking rocker arm 23 to valve actuation member 8.

By way of oscillating motion of valve actuation member 8, cam surface 20*a* of valve actuation member 8 functions to create opening and closing actions of intake valve 3, while being kept in rolling-contact with roller 15 of swing arm 6.

Figure 14:
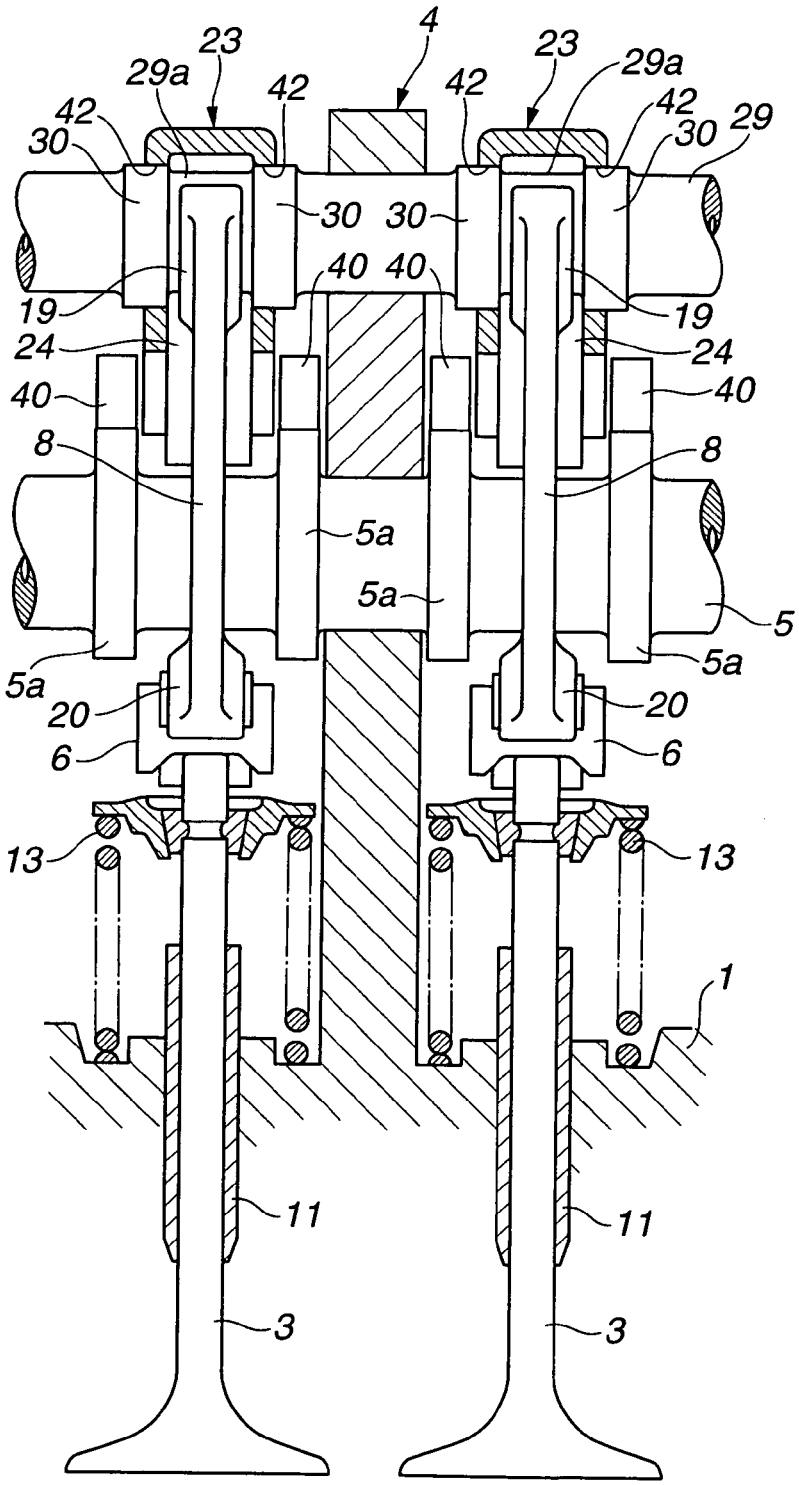
FIG. 14 is an elevation view showing the valve operating apparatus of the fourth embodiment, partly cross-sectioned.

As can be seen from the elevation view of FIG. 14, in the valve operating apparatus of the fourth embodiment, the drive cam pair 5*a*, 5*a* and the associated valve actuation member 8 are axially spaced from each other, and two drive cams 5*a*, 5*a* associated with one intake valve 3 are separated from each other. Instead of using such an axially spaced layout of the drive cam pair 5*a*, 5*a* and valve actuation member 8, a single drive cam 5*a*, associated with one intake valve 3, and valve actuation member 8, associated with the same intake valve, may be essentially aligned with each other but not axially spaced from each other by devising the profile of arcuate portion 16, curved in a manner so as to bypass the outer periphery of camshaft 5. In the case of the aligned layout of drive cam 5*a* and valve actuation member 8 that the sidewall surface of drive cam 5*a* and the sidewall surface of valve actuation member 8 are arranged almost in the same plane, arcuate portion 16 must be satisfactorily curved in a manner so as to bypass the cam profile of drive cam 5*a* as well as the outer periphery of camshaft 5. Additionally, the internal surface 16*a* of arcuate portion 16 must be configured to almost conform to the curvature of the outer periphery of drive cam 5*a*, such that clockwise movement of valve actuation member 8 is cushionedly restricted or limited or absorbed and thus shock load or strong collision or strong interference between drive cam 5*a* and valve actuation member 8 can be certainly avoided. As discussed above, the aligned layout of drive cam 5*a* and valve actuation member 8 as well as the axially spaced layout may be applied.

Figure 17:
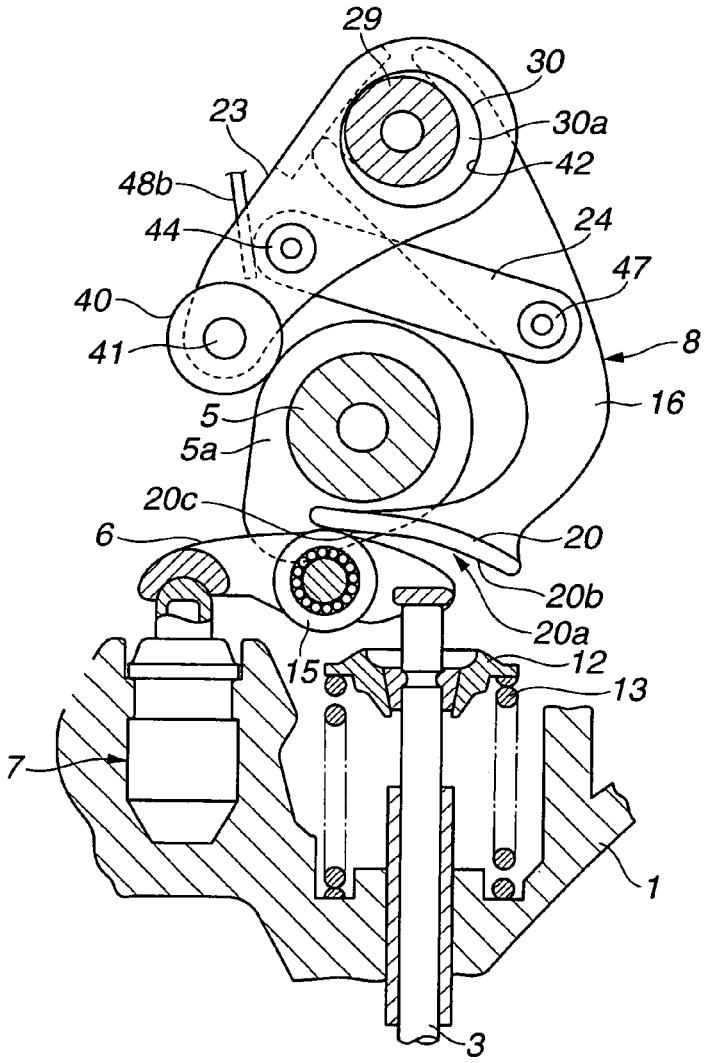
FIG. 17 is an explanatory drawing showing the operation of the valve operating apparatus of the fourth embodiment shown in FIGS. 13-16 during minimum valve lift control.

The operation (variable lift control action) of variable valve lift mechanism 9, incorporated in the apparatus of the fourth embodiment, and constructed by (i) the motion-transmission mechanism comprised of the roller pair 40, 40, rocker arm 23 and link member 24, and (ii) the control mechanism comprised of control shaft 29, the control cam pair 30, 30, and actuator 31, is substantially identical to those of the first, second, and third embodiments. In a low-speed low-load range, for example, during idling, as shown in FIGS. 13 and 17, the control cam pair 30, 30, associated with the same intake valve 3 are adjusted to and held at their desired angular positions suited to the low-speed low-load operation via control shaft 29 by means of actuator 31. Thus, the thick-walled portion 30*a* of control cam 30 is displaced and held at the lower right position with respect to the axis P of control shaft 29 (see FIGS. 13 and 17). As a result of this, the attitude/position of rocker arm 23 shifts or displaces slightly clockwise (that is, in a direction of displacement of the thick-walled portion 30*a*) via the cam hole pair 42, 42, and thus link member 24 rotates valve actuation member 8 counterclockwise. As a result, the contact area of the cam surface 20*a* in rolling-contact with roller 15 of swing arm 6 is shifted from the substantially central concave portion of cam surface 20*a* towards the base-circle surface 20*c* (i.e., leftwards in the side view shown in FIG. 17). Therefore, the valve lift amount of intake valve 3 is adjusted to a small lift amount.

Figure 18:
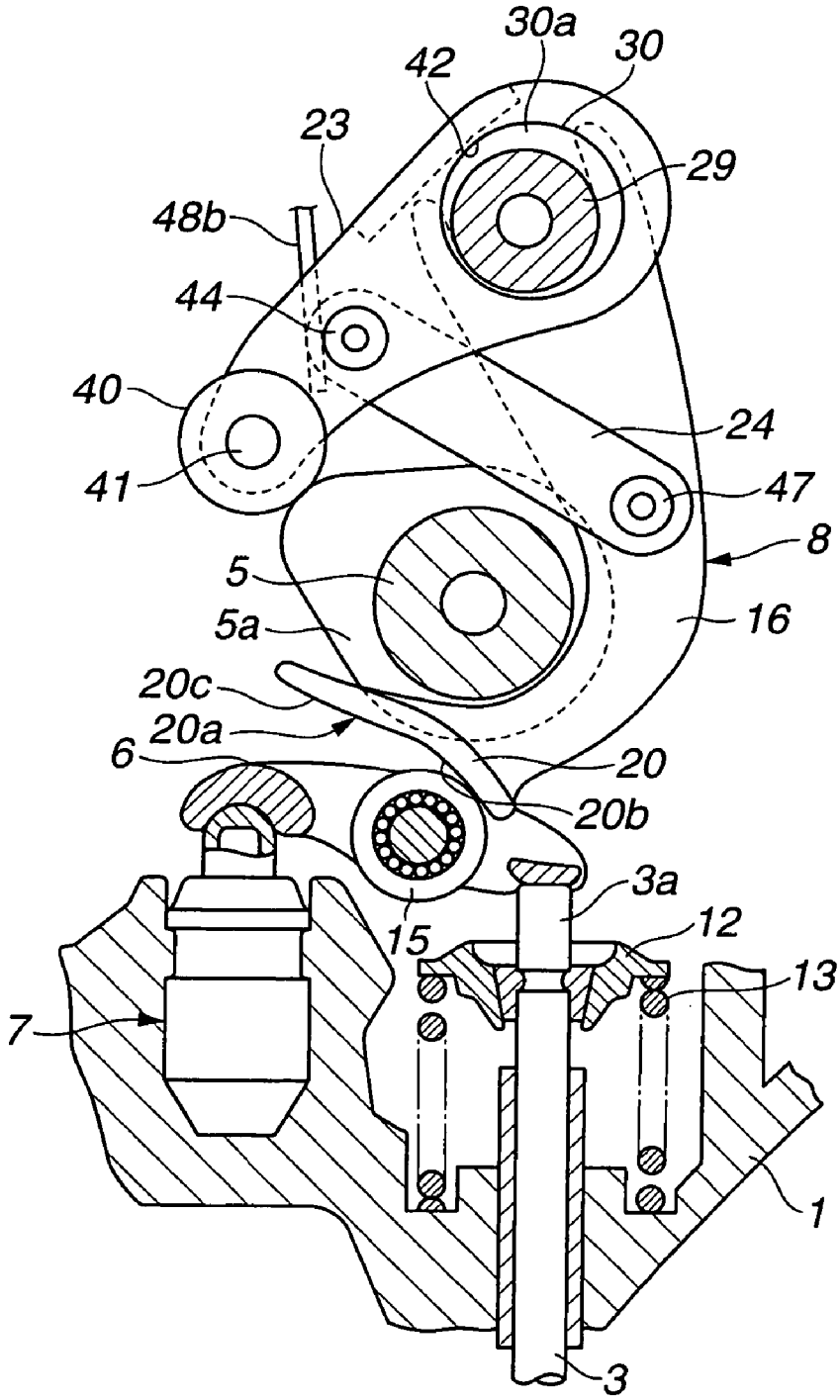
FIG. 18 is an explanatory drawing showing the operation of the valve operating apparatus of the fourth embodiment shown in FIGS. 13-16 during maximum valve lift control.

In contrast, when shifting to a high-speed high-load range, as shown in FIG. 18, the thick-walled portion 30*a* of control cam 30 is displaced and held at the upper position with respect to the axis P of control shaft 29. As a result of this, the attitude/position of rocker arm 23 shifts or displaces slightly counterclockwise (that is, in a direction of displacement of the thick-walled portion 30*a*) via the cam hole pair 42, 42, and thus valve actuation member 8 is rotated slightly clockwise via link member 24. The contact area of the cam surface 20*a* in rolling-contact with roller 15 of swing arm 6 is shifted towards the lift surface 20*b* (i.e., rightwards in the side view shown in FIG. 18). Therefore, the valve lift amount of intake valve 3 is adjusted to a large lift amount.

Also in the apparatus of the fourth embodiment, valve actuation members 8, 8 included in the multi-link mechanism are configured, so that valve actuation members 8, 8 are compactly laid out within a limited space in a such a manner as to bypass the outer periphery of camshaft 5 by virtue of the respective arcuate portions 16, 16. Thus, the apparatus of the fourth embodiment of FIGS. 13-18 can provide the same effects (i.e., utilization of the existing camshaft-to-cylinder head layout, lower valve operating system installation time and costs and smaller space requirements of overall system) as the first to third embodiments.

Additionally, in the valve operating apparatus of the fourth embodiment, the roller pair 40, 40 of rocker arm 23 can be brought into rolling-contact with the respective outer peripheral surfaces of drive cam pair 5*a*, 5*a* by means of torsion spring 48. By virtue of the spring force of torsion spring 48, it is possible to enhance the motion-transmission efficiency, that is, the torque transmission efficiency of torque produced by the drive cam pair 5*a*, 5*a*.

As set out above, the spring force of torsion spring 48 acts on the substantially center portion of rocker arm 23 via the annular-grooved support roller 45 in such a manner as to permanently force the roller pair 40, 40 of the first end of rocker arm 23 into contact with the outer peripheral surfaces of drive cams 5*a*, 5*a*. And thus, it is possible to directly suppress or avoid movement of the roller pair 40, 40 of rocker arm 23 out of contact with the respective outer peripheral surfaces of drive cams 5*a*, 5*a*, by way of the inertial force of valve actuation member 8 oscillating during opening and closing actions of intake valve 3.

As a result of the spring force application of torsion spring 48, control cams 30, 30 are forced in their rotation directions that the valve lift of intake valve 3 decreases. And thus, it is possible to reduce the negative torque component of alternating torque acting on each of control cams 30, 30. That is to say, as explained previously by reference to the three arrows indicative of the respective components of the spring force created by torsion spring 48 in FIG. 13, the spring force can be distributed into (i) the component of force transmitted from roller shaft 41 through the roller pair 40, 40 and acting on the respective outer peripheral surfaces of the drive cam pair 5*a*, 5*a*, (ii) the component of force acting on link member 24 via support roller 45, and (iii) the component of force transmitted through cam hole 42 of rocker arm 23, control cam 30, and the coaxial shaft portion 29*a* of control shaft 29 and acts on valve actuation member 8. By virtue of such distribution of the spring force of torsion spring 48, that is, the three distributed components of force indicated by the three arrows in FIG. 13, it is possible to effectively suppress the magnitude of the component of force actually acting on control shaft 29 due to the spring force of torsion spring 48. And thus, it is possible to effectively suppress the occurrence of undesirable vibrations and noise of electric actuator 31 having a driving connection with control shaft 29.

Additionally, the other spring end 48*b* of torsion spring 48 is fitted into the annular groove of support roller 45 under preload. Thus, even when the attitude of valve actuation member 8 is changing, the sliding motion of the other spring end 48*b* can be converted into rolling motion (rotary motion) of support roller 45, thus reducing undesired friction/wear of the other spring end 48*b*. Also, the rolling contact between the other spring end 48*b* and support roller 45 contributes to the stabilized spring load application from torsion spring 48 to support roller 45.

Figure 19:
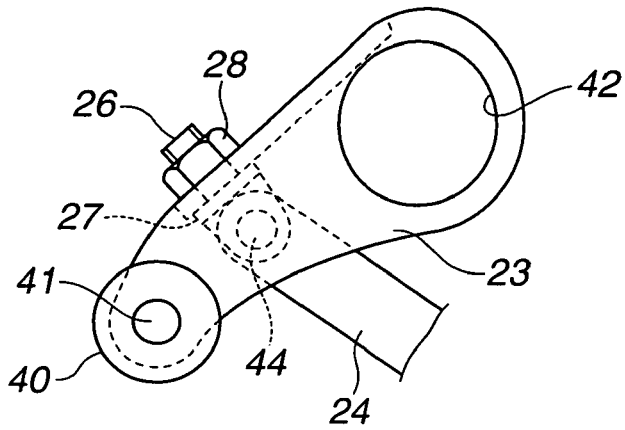
FIG. 19 is a side view of the essential part of a modification, wherein an adjusting mechanism is further provided in the valve operating apparatus, and which is modified from the fourth embodiment shown in FIGS. 13-18.
Figure 20:
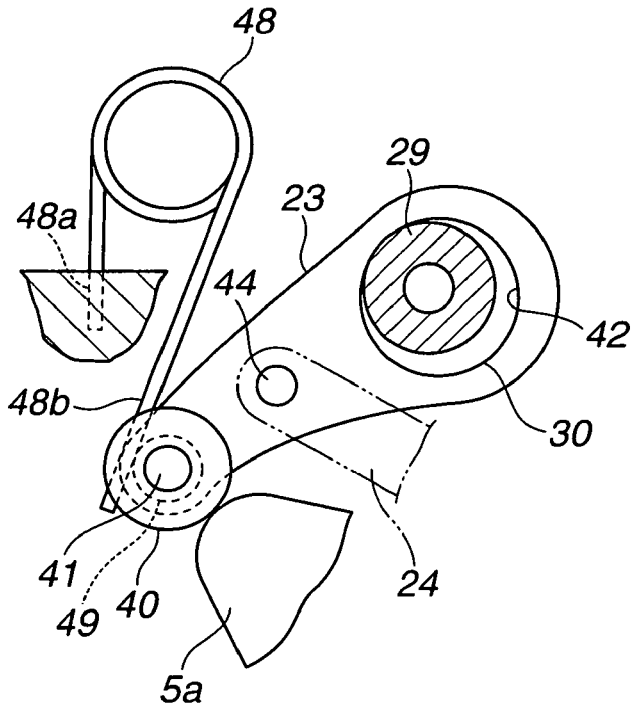
FIG. 20 is a side view of the essential part of the modified valve operating apparatus, showing a modified spring-loading state of the torsion spring.

Referring now to FIG. 19, there is shown a modification of the valve operating apparatus of the fourth embodiment of FIGS. 13-18. In the modification of FIG. 19, an adjusting mechanism substantially identical to the adjusting mechanism (adjusting bolt 26, shim 27, and nut 28) used in the apparatus of the first embodiment of FIGS. 1-7 is interleaved between the left-hand end of link member 24 and rocker arm 23. In a similar manner to the first embodiment, the adjusting mechanism used in the modified apparatus shown in FIG. 19 is comprised of adjusting bolt 26, washer-like shim 27, and nut 28. The D-shaped tab-like portion of adjusting-bolt head 26*a* has a pin-insertion hole 26*b* bored therein. Connecting pin 44 is fitted into holes 43, 24*a*, 26*b*, 24*a*, and 43. Adjusting bolt 26 is fixedly connected to rocker arm 23 by tightening nut 28. Properly exchanging the shim 27 by a new shim 27 having a different thickness allows extremely small adjustments for the entire length of a linkage, containing link member 24 and rockably interconnecting the substantially center portion of rocker arm 23 and the substantially center portion of valve actuation member 8, to be made. The extremely small adjustments for the entire linkage length enable extremely small adjustments for the valve lift of intake valve 3 via cam portion 20 and roller 15 of swing arm 6. In the case of the modification shown in FIG. 19, owing to the provision of the adjusting mechanism (26, 27, 28) between the substantially center portion of rocker arm 23 and link member 24, the annular-grooved support roller 45 and torsion spring 48 must be shifted from their installation positions shown in FIG. 13. For instance, as can be seen from a support roller denoted by reference sign 49 in FIG. 20, the annular-grooved support roller may be configured to be rotatably attached to roller shaft 41 of the roller pair 40, 40 in rolling contact with the respective drive cams 5*a*, 5*a*, and the other spring end 48*b* is fitted into the annular groove of support roller 49 attached to roller shaft 41 in such a manner as to permanently force the roller pair 40, 40 toward the respective drive cams 5*a*, 5*a*. That is, roller shaft 41 serves as the common roller shaft for the annular-grooved support roller 49 as well as the roller pair 40, 40. When installing torsion spring 48 as shown in FIG. 20 so that the other spring end 48*b* is in fitted into the annular groove of support roller 49 attached to the common roller shaft 41 for the roller pair 40, 40, there is a less application of the component of spring force of torsion spring 48 to each control cam 30. Thus, it is possible to effectively avoid the rotational energy (driving energy) of control shaft 29 from being undesirably reduced due to the spring force of torsion spring 48, thus minimizing the driving energy of control shaft 29 as much as possible. This contributes to the improved fuel economy.

As can be appreciated from the above, the installation position of torsion spring 48 may be set arbitrarily, or instead of using torsion spring 48 another type of biasing means or preloading means capable of bringing the roller pair 40, 40 into contact with the respective drive cams 5*a*, 5*a*. For example, as the preloading means, a coil spring may be used. In such a case, one coiled spring end is fixedly connected to the stationary bearing block, namely the intermediate bearing block 4*b* of the second bearing block 4 mounted on cylinder head 1, whereas the other coiled spring end is fixedly connected to the upper surface portion of the rocker-arm lower end, interconnecting and formed integral with the circular-arc shaped rocker-arm sidewall portions, such that rollers 40, 40 are permanently forced against the respective cam surfaces of drive cams 5*a*, 5*a*.

In the shown embodiment, the outside diameter of control cam (eccentric cam) 30 is dimensioned to be larger than that of control shaft 29. In lieu thereof, control cam 30 may be formed integral with control shaft 29 as a crank cam whose outside diameter is smaller than that of control shaft 29.

The entire contents of Japanese Patent Application Nos. 2005-187511 (filed Jun. 28, 2005) and 2006-47658 (filed Feb. 24, 2006) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve operating apparatus of an internal combustion engine comprising:

a drive shaft adapted to be linked to an engine crankshaft from which a driving force is transmitted to the drive shaft, the drive shaft having a drive cam;

a control shaft whose angular position is adjusted depending on an engine operating condition, the control shaft having a coaxial shaft portion laid out coaxially with a rotation axis of the control shaft and a control cam whose axis is deviated from the control-shaft rotation axis;

a rocking member that oscillates on the control cam, which is a fulcrum of oscillating motion of the rocking member, by an oscillating force converted from rotary motion of the drive cam; and a valve actuation member that oscillates on the coaxial shaft portion, which is a fulcrum of oscillating motion of the valve actuation member, by the oscillating force transmitted from the rocking member, for opening and closing an engine valve.

2. The valve operating apparatus as claimed in claim 1, wherein the drive shaft is laid out near an axis of a valve stem of the engine valve, and the valve actuation member has an arcuate portion that is curved to bypass the drive shaft.

3. The valve operating apparatus as claimed in claim 2, wherein an installation position of the valve actuation member is offset from an installation position of the drive cam in a direction of an axis of the drive shaft.

4. The valve operating apparatus as claimed in claim 1, wherein the valve actuation member has a pivotal-fitting portion that enables the valve actuation member to be installed on the coaxial shaft portion from a substantially radial direction of the control shaft, and the control cam is formed integral with the control shaft.

5. The valve operating apparatus as claimed in claim 4, wherein the pivotal-fitting portion has a circular fitting hole, which is bored in a center of the pivotal-fitting portion and to which the coaxial shaft portion is fitted, and two opposing cut-out portions extending substantially radially outwards from a center of the fitting hole and formed in an outer peripheral wall of the pivotal-fitting portion defining the fitting hole, the cut-out portions defining an opening end that enables the valve actuation member to be installed on the coaxial shaft portion from the substantially radial direction of the control shaft.

6. The valve operating apparatus as claimed in claim 1, further comprising:

a link arm, to which the drive cam is slidably fitted and which is pivotably linked to the rocking member, wherein the drive cam is a cylindrical cam having a circular cam profile and an axis radially deviated from an axis of the drive shaft.

7. The valve operating apparatus as claimed in claim 1, further comprising:

a link member interconnecting the rocking member and the valve actuation member to permit oscillating motions of the rocking member and the valve actuation member.

8. The valve operating apparatus as claimed in claim 1, further comprising:

a swing arm swingingly interleaved between the valve actuation member and a valve stem end of the engine valve, wherein the valve actuation member has a cam portion in abutted-engagement with the swing arm, and the swing arm has a swinging portion in abutted-engagement with the valve stem end.

9. The valve operating apparatus as claimed in claim 8, further comprising a roller rotatably attached to the swing arm and located at an abutment portion between the swing arm and the cam portion, wherein the cam portion is in rolling-contact with the roller.

10. The valve operating apparatus as claimed in claim 8, wherein the cam portion oscillates through a clearance space defined between the drive shaft and the swing arm, while being kept in sliding-contact with an abutment portion of the swing arm in abutted-engagement with the cam portion.

11. A valve operating apparatus of an internal combustion engine comprising:

a drive cam formed integral with a drive shaft adapted to be linked to an engine crankshaft from which a driving force is transmitted to the drive shaft;

a control cam formed integral with a control shaft whose angular position is adjusted depending on an engine operating condition, the control cam having an axis deviated from a rotation axis of the control shaft;

a rocking member that oscillates by an oscillating force converted from rotary motion of the drive cam;

a valve actuation member that opens and closes an engine valve by the oscillating force transmitted from the rocking member;

the rocking member rockably supported on the control cam, which is a fulcrum of oscillating motion of the rocking member;

the valve actuation member rockably supported on the control shaft, which is a fulcrum of oscillating motion of the valve actuation member; and the fulcrums being laid out in close proximity to each other.

12. The valve operating apparatus as claimed in claim 11, wherein the valve actuation member has an arcuate portion that is curved to bypass the drive shaft, and an attitude of the valve actuation member is changed by way of pivoting motion of the valve actuation member around the drive shaft through the arcuate portion, for variably adjusting a valve lift and a valve timing of the engine valve.

13. The valve operating apparatus as claimed in claim 2, wherein:

an attitude of the valve actuation member is changed by way of pivoting motion of the valve actuation member created by an attitude change of the rocking member, for variably adjusting a valve lift and a valve timing of the engine valve.

14. A valve operating apparatus of an internal combustion engine, capable of variably controlling a valve lift and a valve timing of an engine valve depending on an engine operating condition, comprising:

a drive shaft adapted to be linked to an engine crankshaft from which a driving force is transmitted to the drive shaft, the drive shaft having a drive cam;

a control shaft whose angular position is adjusted depending on the engine operating condition, the control shaft having a coaxial shaft portion laid out coaxially with a rotation axis of the control shaft and a control cam whose axis is deviated from the control-shaft rotation axis;

a rocking member that oscillates on the control cam, which is a fulcrum of oscillating motion of the rocking member, by an oscillating force converted from rotary motion of the drive cam;

a valve actuation member that oscillates on the coaxial shaft portion, which is a fulcrum of oscillating motion of the valve actuation member, by the oscillating force transmitted from the rocking member;

a cam follower being in abutted-engagement with the valve actuation member for opening and closing the engine valve; and a mutual position relationship of the drive shaft, the control shaft, and the cam follower being defined by a layout that a distance between the drive shaft and the cam follower is dimensioned to be shorter than a distance between the control shaft and the cam follower.

15. The valve operating apparatus as claimed in claim 14, wherein the valve actuation member has an arcuate portion that is curved to bypass the drive shaft while permitting pivoting motion of the valve actuation member around the drive shaft, and an internal surface of the arcuate portion is configured to substantially conform to a curvature of an outer periphery of the drive shaft.

16. A valve operating apparatus of an internal combustion engine comprising:

a drive shaft adapted to be linked to an engine crankshaft from which a driving force is transmitted to the drive shaft, the drive shaft having a drive cam;

a control shaft whose angular position is adjusted depending on an engine operating condition, the control shaft having a coaxial shaft portion laid out coaxially with a rotation axis of the control shaft and a control cam whose axis is deviated from the control-shaft rotation axis;

a rocking member abutting at a first end of both ends with an outer peripheral surface of the drive cam from which rotary motion is transmitted to the first end, the rocking member rockably mounted at the second end on the control cam, which is a fulcrum of oscillating motion of the rocking member;

a valve actuation member that oscillates on the coaxial shaft portion, which is a fulcrum of oscillating motion of the valve actuation member, by the oscillating force transmitted from the rocking member through a link member laid out inside of both of the rocking member and the valve actuation member, for opening and closing an engine valve; and a preloading means that forces the first end of the rocking member into abutted-engagement with the outer peripheral surface of the drive cam.

17. The valve operating apparatus as claimed in claim 16, wherein the drive shaft is laid out near an axis of a valve stem of the engine valve, and an installation position of the valve actuation member is offset from an installation position of the drive cam in a direction of an axis of the drive shaft, and the valve actuation member has an arcuate portion that is curved to bypass the drive shaft.

18. The valve operating apparatus as claimed in claim 16, wherein a first end of both ends of the link member is linked to a substantially center portion of the rocking member via a first pivot pin and the second end of the link member is linked to a substantially center portion of the valve actuation member via a second pivot pin, and the preloading means forces the first end of the rocking member toward the drive cam through the first pivot pin.

19. The valve operating apparatus as claimed in claim 16, further comprising a support roller rotatably attached to the first end of the rocking member in abutted-engagement with the outer peripheral surface of the drive cam, wherein the preloading means has a stationary end adapted to be fixedly connected to a cylinder head and a spring-loading end in rolling-contact with the support roller under preload for forcing the first end of the rocking member toward the drive cam.

20. A valve operating apparatus of an internal combustion engine, capable of variably controlling a valve lift and a valve timing of an engine valve depending on an engine operating condition, comprising:

a drive shaft adapted to be linked to an engine crankshaft from which a driving force is transmitted to the drive shaft, the drive shaft having a drive cam;

a control shaft whose angular position is adjusted depending on the engine operating condition, the control shaft having a coaxial shaft portion laid out coaxially with a rotation axis of the control shaft and a control cam having an axis deviated from the control-shaft rotation axis;

a rocking member that oscillates on the control cam, which is a fulcrum of oscillating motion of the rocking member, by an oscillating force converted from rotary motion of the drive cam;

a valve actuation member that oscillates on the coaxial shaft portion, which is a fulcrum of oscillating motion of the valve actuation member, by the oscillating force transmitted from the rocking member, for opening and closing the engine valve;

the rocking member and the valve actuation member being pivotably supported on the control shaft; and the drive shaft being laid out below the control shaft, the drive shaft being offset from the control shaft toward a valve stem end of the engine valve.

* * * * *